US010394185B2

(12) United States Patent
Ushiozu et al.

(10) Patent No.: US 10,394,185 B2
(45) Date of Patent: Aug. 27, 2019

(54) IMAGE FORMING APPARATUS

(71) Applicant: CANON KABUSHIKI KAISHA, Tokyo (JP)

(72) Inventors: Hidehiro Ushiozu, Mishima (JP); Yuji Mitsui, Susono (JP); Keita Nakajima, Suntou-gun (JP); Koji Miwa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/159,856

(22) Filed: Oct. 15, 2018

(65) Prior Publication Data

US 2019/0049894 A1 Feb. 14, 2019

Related U.S. Application Data

(60) Division of application No. 15/827,303, filed on Nov. 30, 2017, now Pat. No. 10,146,174, which is a continuation of application No. 15/074,434, filed on Mar. 18, 2016, now Pat. No. 9,869,964, which is a division of application No. 14/191,848, filed on Feb. 27, 2014, now Pat. No. 9,348,301, which is a continuation of application No. 13/151,573, filed on Jun. 2, 2011, now Pat. No. 8,755,718.

(30) Foreign Application Priority Data

Jun. 4, 2010 (JP) ..... 2010-128897
Jun. 4, 2010 (JP) ..... 2010-128898

(51) Int. Cl.

| | |
|---|---|
| ***G03G 21/16*** | (2006.01) |
| ***G03G 15/04*** | (2006.01) |
| ***G03G 21/18*** | (2006.01) |

(52) U.S. Cl.
CPC ... *G03G 21/1647* (2013.01); *G03G 15/04054* (2013.01); *G03G 21/1666* (2013.01); *G03G 21/185* (2013.01)

(58) Field of Classification Search
CPC ... G03G 2221/1684; G03G 2221/1869; G03G 21/1666; G03G 21/1647
See application file for complete search history.

(56) References Cited

U.S. PATENT DOCUMENTS 8,078,085 B2 12/2011 Okabe
8,249,485 B2 8/2012 Horikawa et al.
(Continued)

FOREIGN PATENT DOCUMENTS

JP 02-162063 A 6/1990
JP 02-188776 A 7/1990
(Continued)

OTHER PUBLICATIONS

Office Action in Japanese Patent Application No. 2014-242940, dated Sep. 15, 2015.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes an LED unit capable of being in an exposing position or a retracted position, and a cartridge capable of being inserted into or pulled out with the LED unit in the retracted position.

20 Claims, 23 Drawing Sheets

(56) References Cited

U.S. PATENT DOCUMENTS

| | | | | |
|---|---|---|---|---|
| 8,452,213 | B2 | 5/2013 | Okabe | |
| 2004/0062573 | A1 | 4/2004 | Matsuda et al. | |
| 2009/0116875 | A1 | 5/2009 | Sugiyama et al. | |
| 2009/0129818 | A1 | 5/2009 | Inoue et al. | |
| 2009/0142092 | A1 | 6/2009 | Sato | |
| 2009/0220250 | A1 | 9/2009 | Funahashi | |
| 2010/0080623 | A1 | 4/2010 | Tanaka et al. | |
| 2010/0119254 | A1 | 5/2010 | Tateishi et al. | |
| 2011/0299873 | A1 | 12/2011 | Ushiozu et al. | |
| 2011/0299883 | A1* | 12/2011 | Suzuki | G03G 15/0894 399/110 |
| 2011/0299885 | A1* | 12/2011 | Taba | G03G 21/185 399/111 |

FOREIGN PATENT DOCUMENTS

| | | | |
|---|---|---|---|
| JP | 02-284174 | A | 11/1990 |
| JP | 07-104567 | A | 4/1995 |
| JP | 8-106244 | A | 4/1996 |
| JP | 2002-091268 | A | 3/2002 |
| JP | 2003-276241 | A | 9/2003 |
| JP | 2004-170821 | A | 6/2004 |
| JP | 2004-212986 | A | 7/2004 |
| JP | 2006-106446 | A | 4/2006 |
| JP | 2008-216331 | A | 9/2008 |
| JP | 2009-119805 | A | 6/2009 |
| JP | 2009-175416 | A | 8/2009 |
| JP | 2009-282352 | A | 12/2009 |
| JP | 5787490 | B2 | 9/2015 |

OTHER PUBLICATIONS

Office Action in Japanese Patent Application No. 2010-128898, dated Apr. 7, 2015.

Office Action in Japanese Patent Application No. 2010-128898, dated Sep. 30, 2014.

* cited by examiner

IMAGE FORMING APPARATUS

BACKGROUND OF THE INVENTION

Field of the Invention

The present invention relates to an electrophotographic image forming apparatus for forming an image on a recording medium in the state that a process cartridge having an electrophotographic photosensitive drum and a process device for acting on the electrophotographic photosensitive drum is detachably mounted to a main body of the image forming apparatus.

Here, the electrophotographic image forming apparatus (hereinafter referred to as 'image forming apparatus') forms an image on a recording medium using an electrophotographic image forming process. The examples of the image forming apparatus include an electrophotographic copying machine, an electrophotographic printer (for example, an LED printer), a facsimile device, and a word processor. As an image forming apparatus, both monochrome image forming apparatuses and color image forming apparatuses are included. The recording medium is a material on which an image is formed by the image forming apparatus, and includes a paper sheet and an OHP sheet. An intermediate transfer member is also included.

In general, the cartridge is, for example, a process cartridge or a developing cartridge which is detachably mounted to the main body of the electrophotographic image forming apparatus to contribute to an image formation process for forming an image on the recording medium. The process cartridge integrates at least one of a charge member, a developing member and a cleaning member as a process device for acting on a drum and the drum into a cartridge and detachably mounts it to the main body of the apparatus. Therefore, the cartridge includes the type of cartridge integrating the developing member as a process device and the drum into a cartridge and detachably mounting it to the main body of the apparatus. The process cartridge also includes the type of cartridge integrating the charge member, the developing member or the cleaning member as a process device and the drum into a cartridge and detachably mounting it to the main body of the apparatus. The type of process cartridge that integrates the drum and the developing member is called an 'integral type'. The type of process cartridge that integrates the drum and the process devices other than the developing member is called a 'discrete type'. The process cartridge can be mounted to and demounted from the main body of the apparatus by a user. For that reason, the maintenance of the main body of the apparatus is easy. In addition, the developing cartridge has a developing roller, accommodates a toner, and is detachably mounted to the main body of the apparatus, wherein the toner is used by the toner roller to develop an electrostatic latent image formed on the drum. In the case of the developing cartridge, the drum is mounted to the main body of the apparatus or a cartridge supporting member. Or, the drum is provided in the discrete type process cartridge (in this case, the process cartridge does not have the developing member). The developing cartridge can also be mounted to and demounted from the main body of the image forming apparatus by the user. For that reason, the maintenance of the main body of the apparatus is easy. As for the cartridge, the integral type process cartridge and the discrete type process cartridge are included. The discrete type process cartridge and the developing cartridge may be paired and used as a cartridge. The drum is fixed to the main body of the apparatus or a cartridge supporting member, and the developing cartridge is detachably mounted to the cartridge supporting member to be actable on the drum. In the present invention, the cartridge, having the electrophotographic photosensitive drum (hereinafter referred to as 'drum') and the process device for acting on the drum, is detachably mounted to the main body of the apparatus for use.

Description of the Related Art

In order to downsize the image forming apparatus, a light emitting device may be used as an exposure device for the drum, wherein the light emitting device has light emitting elements arrayed in the longitudinal direction (in the direction of the shaft) of the drum for emitting in accordance with image information to expose the drum. For example, in the image forming apparatus using LEDs as the light source of the exposure device, a condenser lens for condensing light emitted from the LEDs onto the drum is provided. Japanese Patent Application Laid-Open No. 2002-91268 describes the image forming apparatus having LEDs as the light source of the exposure device provided for the process cartridge that integrates the drum, the developing member and the like, and also having a condenser lens provided for the main body of the apparatus.

SUMMARY OF THE INVENTION

The present invention further develops the above-described conventional technique. An object of the present invention is to provide an electrophotographic image forming apparatus that has improved usability for the user pushing in and pulling out the process cartridge without degrading the accuracy of positioning the electrophotographic photosensitive drum, the light emitting device and the lens.

Another object of the present invention is to provide an image forming apparatus that forms an image on a recording medium in a state where a cartridge having a photosensitive drum is detachably mounted to a main body of said image forming apparatus, comprising a light emitting device unit having a light emitting device and a lens, the light emitting device having a plurality of light emitting elements provided in a longitudinal direction of the photosensitive drum for emitting in accordance with image information to expose the photosensitive drum in accordance with the image information, and the lens condensing light emitted from the light emitting elements for exposing the photosensitive drum, and a light emitting unit supporting member that supports the light emitting unit so that the light emitting unit that is movable between an exposing position and a retracted position, the exposing position being a position for exposing the photosensitive drum via the lens as the light emitting elements emit and that the retracted position being a position at which the light emitting unit is retracted from the exposing position, wherein the cartridge is capable of being inserted into or pulled out from the main body in the longitudinal direction of the photosensitive drum along the light emitting unit in the retracted position.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

[Brief Configuration of Electrophotographic Image Forming Apparatus]

Figure 1A:
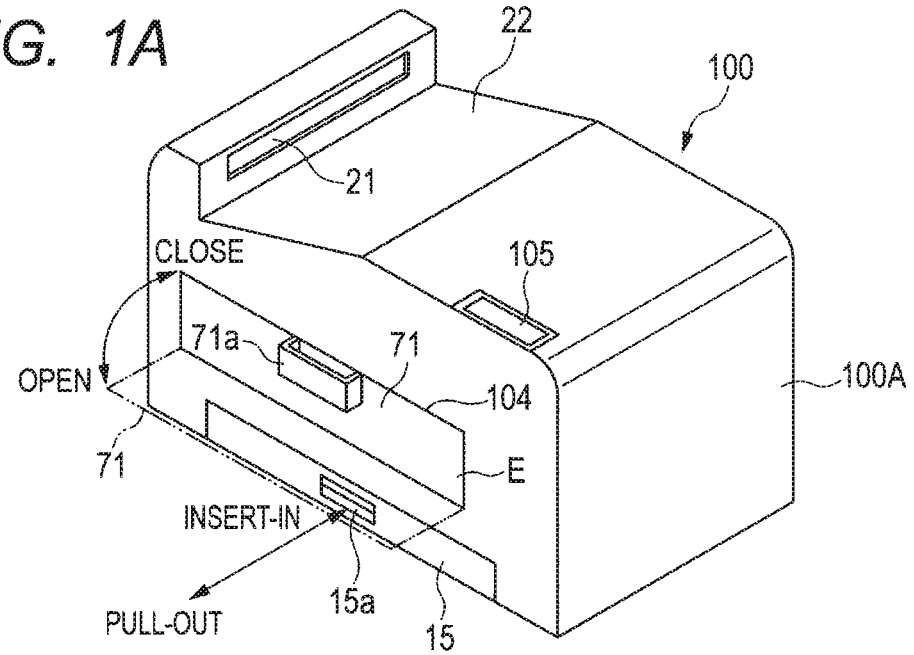
FIG. 1A is an outside perspective view of an electrophotographic image forming apparatus and FIG. 1B is an outside perspective view of the same apparatus with a door opened for one of process cartridges pulled out from or inserted into a mounted portion in the main body of the apparatus.
Figure 1B:
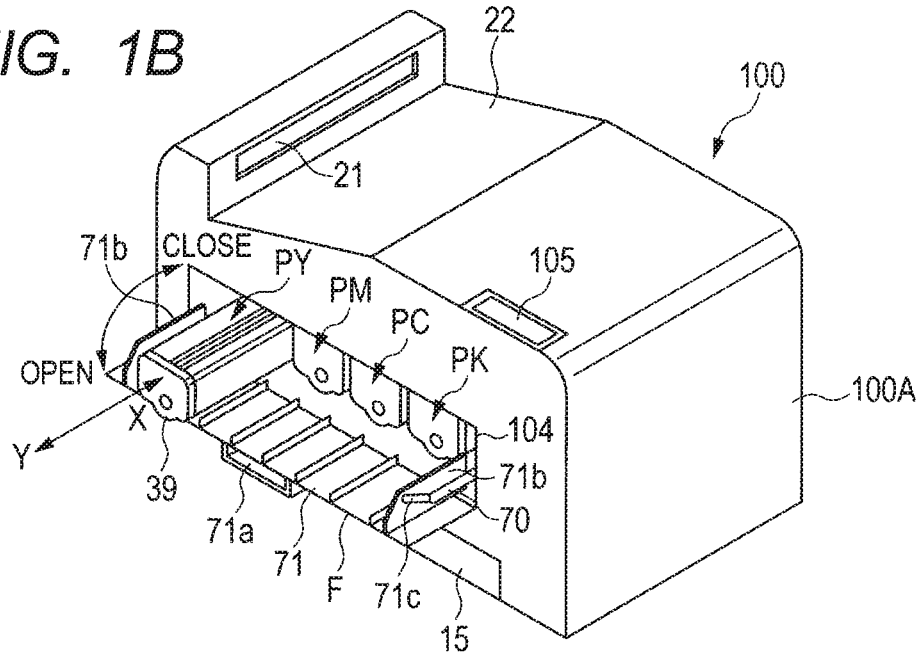
Figure 2A:
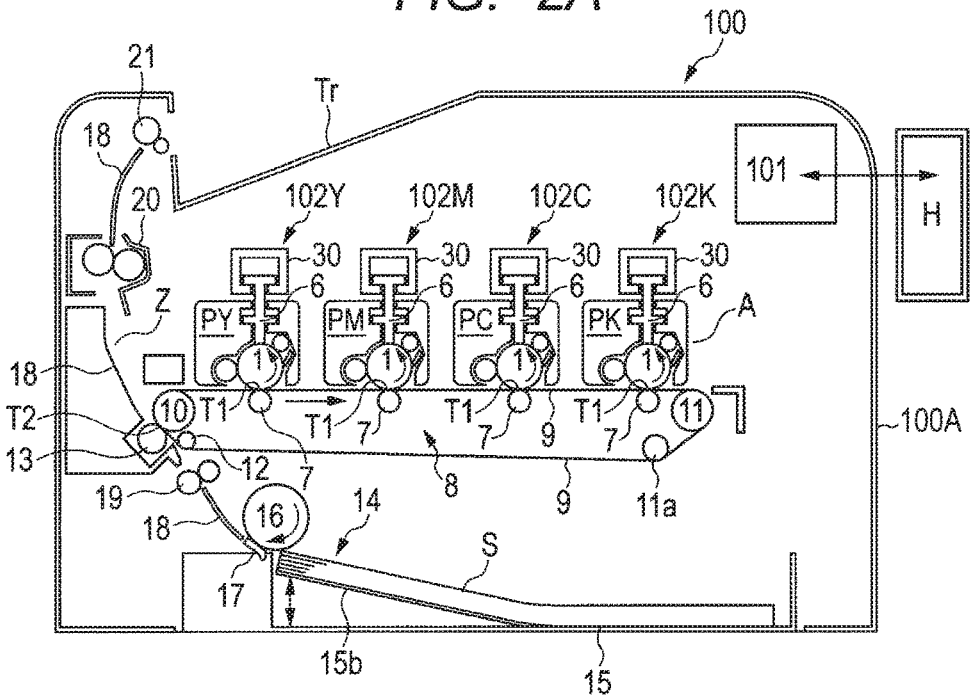
FIG. 2A is a longitudinal sectional front view of the electrophotographic image forming apparatus and FIG. 2B is a partial enlarged view of the electrophotographic image forming apparatus shown in FIG. 2A.
Figure 2B:
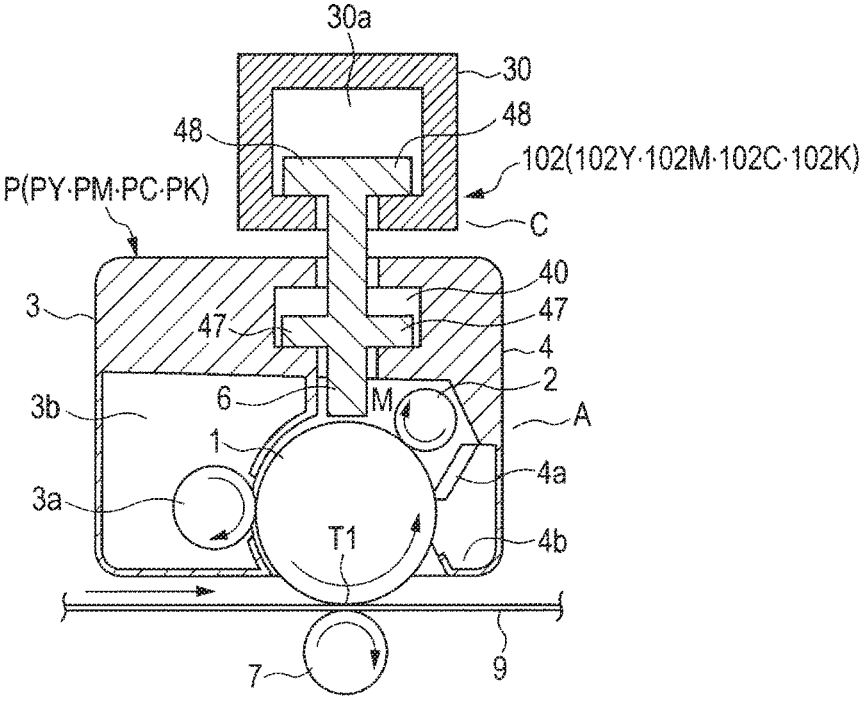
Figure 3A:
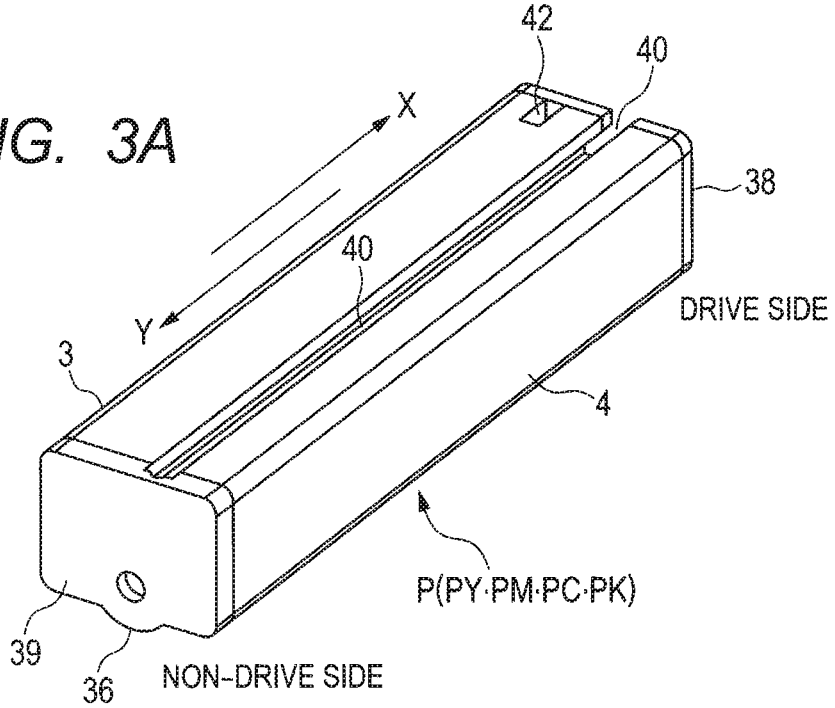
FIG. 3A is an outside perspective view of a process cartridge from the viewpoint of a non-driven side and FIG. 3B is an outside perspective view of the process cartridge from the viewpoint of a driven side.
Figure 3B:
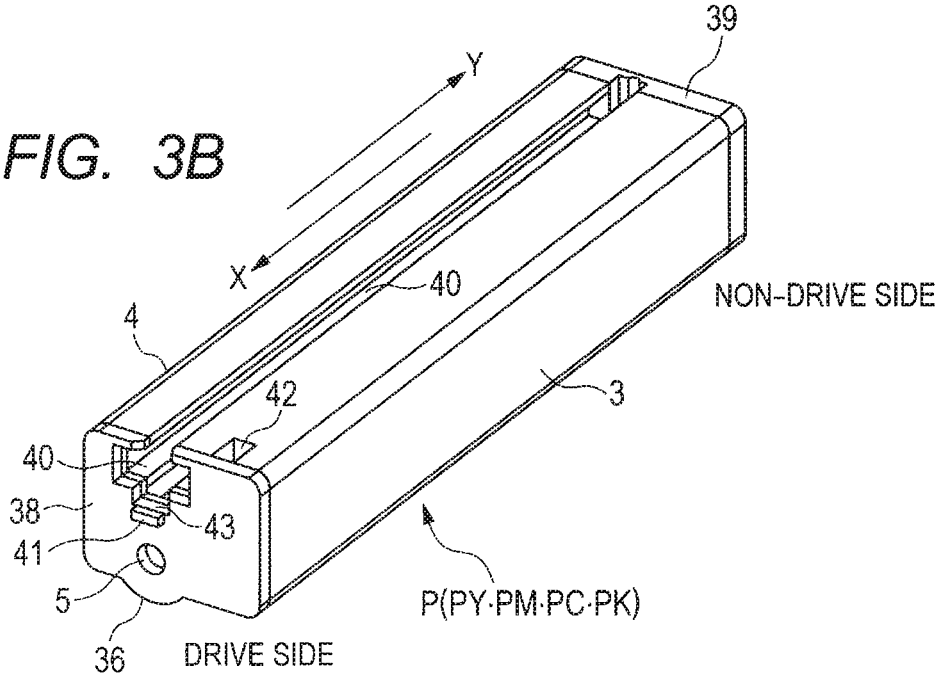

FIG. 1A is an outside perspective view of an electrophotographic image forming apparatus 100 of the embodiment and FIG. 1B is an outside perspective view of the apparatus 100 with a front door 71 opened for one of process cartridges pulled out from or inserted into a mounted portion in the main body 100A of the apparatus. FIG. 2A is a longitudinal sectional front view of the apparatus 100 and FIG. 2B is a partial enlarged view of FIG. 2A. FIG. 3A is an outside perspective view of a process cartridge P from the viewpoint of a non-driven side and FIG. 3B is a view of the same from the viewpoint of a driven side. The apparatus 100 is an in-line type color electrophotographic image forming apparatus of intermediate transfer type for forming a color image on a recording medium S with four process cartridges P, each having an electrophotographic photosensitive drum 1, detachably mounted to a mounted portion in the main body 100A of the apparatus respectively. For an exposure device (light emitting device) for exposing the drum 1, an LED unit (LED type exposure device) is used. More specifically, the apparatus 100 is a full-color (four color) LED printer using an electrophotographic process that forms a color image on the recording medium S based on an electric image signal input from a host device H such as a PC and an image reader to a control circuit portion 101. The recording medium S (hereinafter referred to as 'recording material') is a paper sheet, an OHP sheet, or a label, for example.

In the description below, the 'front side' (frontal side) refers to the side where a door (front door) 71 for opening and closing the apparatus is provided. The 'back side' (rear side) refers to the side opposite to the front side. The 'front-back direction' refers to the direction from the back side to the front side of the apparatus (frontward) and the direction opposite to the frontward direction (i.e., rearward). The 'left and right' refers to left and right viewed from the front side of the apparatus. The 'left-right direction' refers to the direction from right to left (leftward direction) and the direction opposite to the leftward direction (i.e., rightward direction). The 'up and down' refers to up and down in the gravity direction. The 'main body 100A' of the apparatus refers to the portion of the apparatus 100 excluding the cartridges P.

The main body 100A of the apparatus has four process cartridges (first to fourth cartridges) placed in a row at mounted portions 102 (102Y, 102M, 102C, 102K) substantially horizontally from the left side to the right side. The first to fourth four cartridges P (PY, PM, PC, PK) are detachably mounted to the mounted portions 102, respectively. The mounted portions 102 have the same configuration. The configuration of the mounted portion 102 will be described later.

The cartridges P are the same electrophotographic process mechanism except for colors of toners contained. The cartridge P of the embodiment has the electrophotographic photosensitive drum 1, and a charging device 2, a developing device 3 and a cleaning device 4 as process devices acting on the drum 1. The devices 1 to 4 are integrated into a cartridge with a predetermined physical relationship between a back side cover 38 and a front side cover 39. The drum 1 is rotatably supported by bearings (not shown) between the covers 38 and 39. The cartridge P is an assembly, the longitudinal direction of which is the rotation axis direction of the drum 1 with a driven side at one end (cover 38 side) and a non-driven side at the other end (cover 39 side) of the drum 1. Each cartridge P is mounted to each corresponding mounted portion 102 in the main body 100A of the apparatus with the driven side at the back side and the non-driven side at the front side. A driven portion 5 is provided for the cover 38 of the cartridge P concentrically with the rotation axis of the drum 1. The charging device 2 is means for uniformly charging the surroundings of the drum 1 to predetermined polarity and electric potential by using a charge roller, a contact charging member. The developing device 3 is means for developing an electrostatic latent image formed on the drum 1 as a toner image with toner powder and has a toner roller 3*a* as a developing member and a toner container 3*b* containing the toner for supplying the toner to the drum 1 inside the frame member of the developing device 3. The cleaning device 4 is means for removing transfer residual toner from the surface of the drum 1 after a primary transfer of a toner image onto an intermediate transfer belt 9, an intermediate recording medium. The cleaning device 4 has a cleaning blade 4*a* as a cleaning member and a residual toner container 4*b* inside the frame member therein. The charging device 2 is integrally supported by the frame member of the cleaning device 4.

The first cartridge PY has a toner container 3*b* in which yellow (Y) toner is contained and forms a toner image of yellow color on a surface of the drum 1. The second cartridge PM has a toner container 3*b* in which magenta (M) toner is contained and forms a toner image of magenta color on the surface of the drum 1. The third cartridge PC has a toner container 3*b* in which cyan (C) toner is contained and forms a toner image of cyan color on the surface of the drum 1. The fourth cartridge PK has a toner container 3*b* in which black (K) toner is contained and forms a toner image of black color on the surface of the drum 1.

In the state that each cartridge P is mounted to each corresponding mounted portion 102 in a predetermined manner and positioned to an image forming position A (latent image forming position), a driving portion (not shown) of the main body 100A side of the apparatus is joined to the driven portion 5. The image forming position A of the cartridge P is a position contributing to form an image on the belt 9, an intermediate transfer member to be described later. To a bias input portion (not shown) at the cartridge P side, a bias output portion (not shown) at the main body 100A side of the apparatus is joined. Corresponding to the drum 1 of each cartridge P placed at the image forming position A, the LED unit (light emitting unit) 6 is placed at a predetermined exposing position M for exposing the drum 1 as an exposure device at the main body 100A side of the apparatus. The unit 6 has a light emitting device having LEDs (light-emitting diode) as light emitting elements arrayed in the longitudinal direction of the drum 1 for emitting in accordance with image information to expose the drum 1 and a lens for condensing light emitted from the LEDs for exposing the drum 1. The unit 6 is exposure means for forming an electrostatic latent image corresponding to an image signal input from the control circuit portion 101 by performing main scan exposure on the surface of the rotating drum 1 that is charged by the charge roller 2 with emission of LEDs selectively controlled in accordance with the image signal.

Below the mounted portion 102, an intermediate transfer belt unit 8 as a transfer member is provided. The unit 8 has a flexible endless belt (intermediate transfer belt) 9 as an intermediate recording medium (intermediate transfer member) and a driver roller 10, a turn roller 11, an auxiliary roller 11*a* and a tension roller 12 for circularly driving the belt 9 by supporting and keeping the belt 9 stretched. The rollers 10 and 12 are provided at the left side in the main body 100A of the apparatus. The rollers 11 and 11*a* are provided at the right side in the main body 100A of the apparatus. A primary transfer roller is in contact with the bottom of the drum 1 of each cartridge P placed at the image forming position A via the top portion of the belt loop of the belt 9. The contacting portion between the drum 1 of each cartridge P and the belt 9 is a primary transfer portion T1. A secondary transfer roller 13 is in contact with the roller 10 via the belt 9. The contacting portion between the roller 13 and the belt 9 is a secondary transfer portion T2.

Below the unit 8, a feeding unit 14 is provided. The unit 14 includes a feeding tray 15, a feeding roller 16 and a separation pad 17. Sheets of recording materials S are stacked in the tray 15. The tray 15 is loadable from the front side of the apparatus 100 (front loading). A recess provided for a front plate of the tray 15 is denoted by 15*a*. At the left side in the main body 100A of the apparatus, a recording material conveyance path Z is provided from the roller 16 to the top left portion in the main body 100A of the apparatus. The conveyance path Z is made of a conveyance guiding plate 18 and the like. From the bottom to the top of the conveyance path Z, a pair of registration rollers 19, the transfer roller 13, a fixing device (heat fix device) 20 and a pair of delivery rollers 21 are provided. The fixing device 20 includes a fixing film unit and a pressure roller. A delivery tray Tr for receiving a recording material with an image formed is provided for the top of the main body 100A of the apparatus.

The operation for forming a full-color image is shown below. Based on an image forming start signal, a driving force is transmitted from the driving portion (not shown) of the main body 100A side of the apparatus to the driven portion 5 of the cartridge P side. That drives the drum 1 to rotate in the counterclockwise direction indicated by an arrow at a predetermined speed. The charge roller 2 rotates following the rotation of the drum 1. The toner roller 3*a* is driven to rotate in the clockwise direction indicated by an arrow at a predetermined speed. The belt 9 is driven to rotate in the clockwise direction indicated by an arrow (forward direction of the drum rotation) at a speed corresponding to the speed of the drum 1. In synchronization with the driving, a predetermined charging bias is applied to the charge roller 2 at predetermined control timing in each cartridge P and the surface of the drum 1 is uniformly charged to a predetermined polarity and potential. The unit 6 has emission of LEDs as light emitting elements selectively controlled in accordance with the image signal input from the control circuit portion 101 and performs the main scan exposure on the drum 1 charged by the charge roller 2. As a result, the electrostatic latent image according to the image signal of the corresponding color is formed on the surface of each drum 1 at predetermined control timing. The formed electrostatic latent image is developed as a toner image by the toner roller 3*a*. A predetermined developing bias is applied to the toner roller 3*a* at predetermined control timing.

Through the above described electrophotographic image forming process operation, a yellow toner image corresponding to a yellow component of a full-color image is formed on the drum 1 of the first cartridge PY. The toner image is transferred onto the belt 9 (intermediate transfer) by the primary transfer portion T1. On the drum of the second cartridge PM, a magenta toner image corresponding to a magenta component of the full-color image is formed. The toner image is transferred onto the belt 9 by the transfer portion T1 so that the image is superimposed on the yellow toner image which has already been transferred on the belt 9. On the drum 1 of the third cartridge PC, a cyan toner image corresponding to a cyan component of the full-color image is formed. The toner image is transferred onto the belt 9 by the transfer portion T1 so that the image is superimposed on the yellow and magenta toner images which have already been transferred on the belt 9. On the drum 1 of the fourth cartridge PK, a black toner image corresponding to a black component of the full-color image is formed. The toner image is transferred onto the belt 9 by the transfer portion T1 so that the image is superimposed on the yellow, magenta and cyan toner images which have already been transferred on the belt 9. Consequently, an unfixed full-color (four-color) toner image is formed on the belt 9 by the yellow, magenta, cyan and black toner images. A primary transfer bias of a predetermined potential in reverse polarity of that of the charge polarity of the toner is applied from the power supply (not shown) to each primary transfer roller 7. After the primary transfer of the toner image onto the belt 9, the residual toner remaining on the surface of the drum 1 is removed by the cleaning device 4 in each cartridge P.

When a lifter plate 15*b* of the tray 15 is raised at predetermined control timing, the top surface of the left side of the recording medium S stacked in the tray 15 comes into contact with the bottom of the roller 16. The roller 16 is driven to rotate in the direction of sending the recording material S to the left. Then, the recording materials stacked at the top in the tray 15 is drawn leftward, separated one by one by the separation pad 17 and sent onto the conveyance path Z. The sent out recording material S is introduced into the secondary transfer portion T2 at predetermined control timing in synchronization with the image formation onto the belt 9 by the pair of rollers 19. A secondary transfer bias of a predetermined potential in reverse polarity of that of the charge polarity of the toner is applied from the power supply (not shown) to the roller 13. Through the conveyance process of the recording materials S at the transfer portion T2, the four color superimposed image on the belt 9 is transferred onto the surface of the recording materials S at a time one by one. The recording material S is moved out from the transfer portion T2, separated from the surface of the belt 9, introduced into the fixing device 20 and heated and pressed by a fixing nip portion. As a result, the toner image is fixed to the recording material S. The recording material S is moved out of the fixing device 20 and discharged as a full-color image formation product onto the tray Tr by the pair of rollers 21. In the embodiment, after the separation of the recording material from the belt 9, secondary transfer residual toner remaining on the surface of the belt 9 is electrostatically deposited on the drum 1 surface at the primary transfer portion T1 of the first cartridge PY and is removed by the cleaning device 4.

[Cartridge Exchange]

As each cartridge P is used for image formation, the toner contained in the container 3*b* is consumed. Then, detecting unit (not shown) for detecting the amount of the toner remaining in each cartridge is provided for each cartridge P. The amount of the remaining toner detected by the detecting unit is compared with a threshold value preset for providing a pre-warning or warning of the lifetime of the cartridge by the control circuit portion 101 of the main body 100A of the apparatus. When the amount of the residual toner in the cartridge is smaller than the preset threshold value, the pre-warning or warning of the lifetime of the cartridge is displayed on a display portion of a printer control portion 105 or a display portion of the host device H. As a result, the image forming apparatus prompts the user to prepare a cartridge for exchange or to replace the cartridge with a fresh one to maintain the output image quality.

In the apparatus 100 of the embodiment, the exchange of the cartridge P is performed as below. On the front side of the main body 100A of the apparatus, a door (openable and closable member) 71 is provided. When the door 71 is opened, an opening 104 at the front side of the main body 100A of the apparatus is opened and the non-driven sides of the cartridges P mounted to the respective mounted portions 102 appear. That allows the user to access the cartridge P to exchange the cartridge P by front access. Mounting and demounting of the cartridge P to and from the mounted portion 102 of the main body 100A of the apparatus is side-oriented, allowing the cartridge P to be mounted and demounted in the rotation axis direction of the drum 1 thereof at the front side of the main body of the apparatus. FIG. 1B shows the apparatus with the first cartridge PY pulled out from or inserted into the mounted portion 102Y in the main body 100A of the apparatus. X is the direction in which the cartridge P is inserted into the main body 100A of the apparatus and Y is the direction in which the cartridge P is pulled out from the main body 100A of the apparatus.

The door 71 is provided on the front side of the main body 100A of the apparatus as the openable and closable member movable between a closing position (shutting position) E for closing the opening 104 and an opening position F for opening the opening 104. In the embodiment, the door 71 can be rotatably opened or closed about a shaft (hinge shaft) 72, provided at the bottom side of the door, with respect to the front side of the main body 100A of the apparatus (FIGS. 5A to 5C, FIGS. 6A and 6B, FIGS. 7A and 7B) where the shaft 72 is supported by a bearing member (not shown) at the main body 100A side of the apparatus. The door 71 can be rotated by the user in the raising direction about the shaft 72 and moved to the closing position E for closing the opening 104. The door at the closing position E can be rotated by the user pulling the door 71 with the fingers at a recess 71*a* toward the front side of the main body 100A of the apparatus about the shaft 72 to substantially horizontal place. As a result, the door 71 can be moved to the opening position F for largely opening the opening 104. The opening 104 is an opening for letting the cartridge P pass through to be inserted into or pulled out from the corresponding mounted portion 102 in the main body 100A of the apparatus.

[Cartridge P]

As described above, the cartridges P (PY, PM, PC, PK) are the same electrophotographic process configuration except for colors of contained toner. The cartridge P of the present embodiment includes the drum 1, the charging device 2, the developing device 3 and the cleaning device 4 integrated into a cartridge with a predetermined physical relationship between the back side cover 38 and the front side cover 39. A notched groove 40 is provided between the cover 38, the driven side, and the developing device 3 and the cleaning device 4. The groove 40 extends from the cover 38 to the cover 39 in the longitudinal direction of the cartridge P. A guide rail portion 47 (the guide portion is at the light emitting device unit side) at the unit 6 side is inserted in the groove 40. As described later, the rail portion 47 functions as a guide for the cartridge P inserted into and pulled out from the mounted portion 102. A positioning hole 43 and an oblong hole (not shown) for positioning the longitudinal direction of the unit 6 are provided for the covers 38 and 39. The cover 38 has a bump surface 41 against a back side frame 106 (FIG. 5) of the main body of the apparatus. A notch 42 is provided for the top surface of the developing device 3 at the cover 38 side. When the cartridge P is inserted into the mounted portion 102, a toggle lever 81 to be described later (FIG. 5) at the main body 100A side of the apparatus is inserted into the notch 42 so that the bump surface 41 bumps against the inside wall of the frame 106.

[Mounted Portion 102]

Figure 5A:
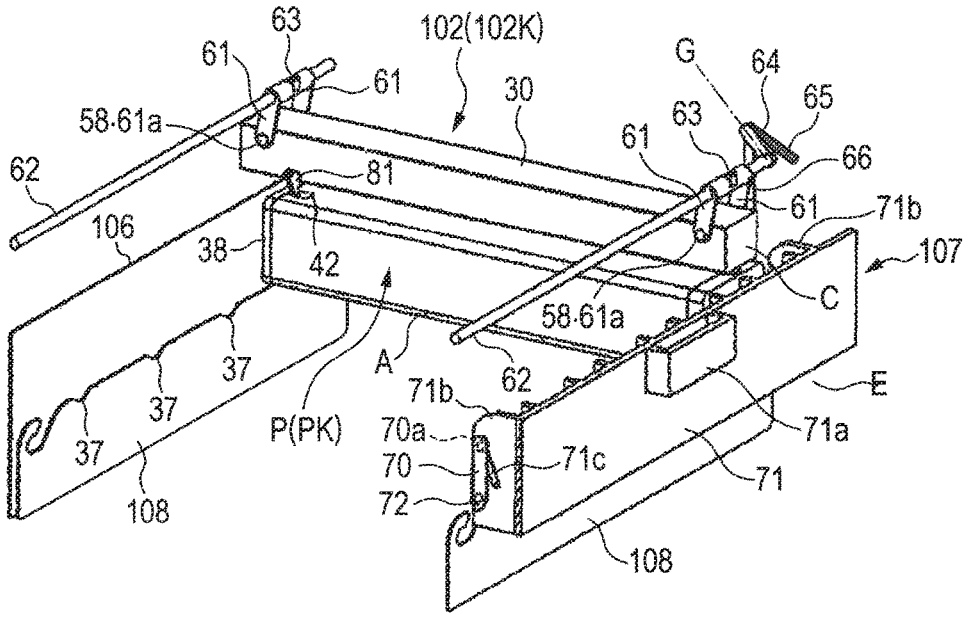
FIG. 5A is an illustration of a moving member when a door is closed.
Figure 7A:
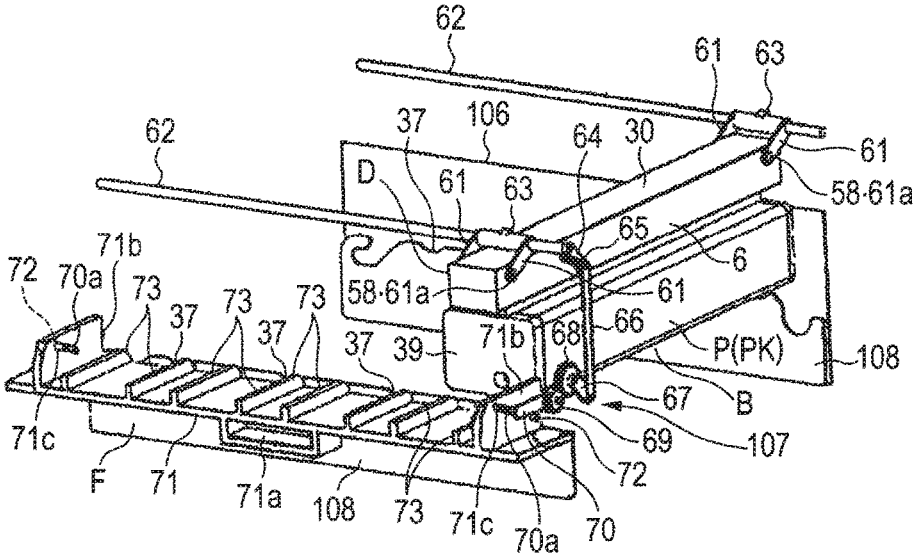
FIGS. 7A-7C are illustrations of the moving member when the door is opened.

The mounted portions 102 (102Y, 102M, 102C, 102K) of the cartridges P are of the same configuration. For convenience of description, the fourth mounted portion 102K will be described below as a representative. FIG. 5A and FIG. 7A are perspective views of the apparatus frame omitting the other cartridges and the other peripheral parts for focusing on the fourth cartridge PK. The mounted portion 102 includes an LED unit 6 as the light emitting device unit, an LED holder 30 as the light emitting device unit supporting member for supporting the unit 6, and a moving member 107 for moving the holder 30. In the embodiment, the guide rail portion 47 is provided as a light emitting device unit side guide portion for guiding the cartridge P inserted into and pulled out from the unit 6.

Figure 4A:
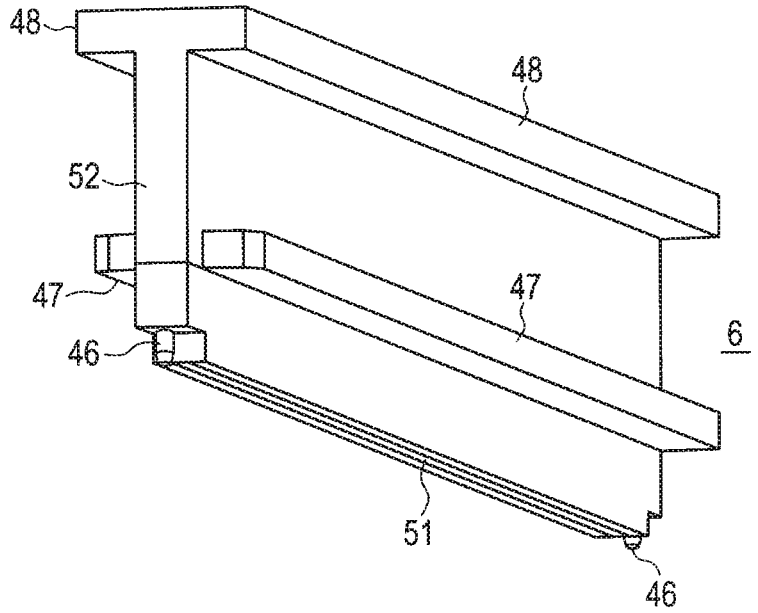
FIG. 4A is an outside perspective view of an LED unit.
Figure 4B:
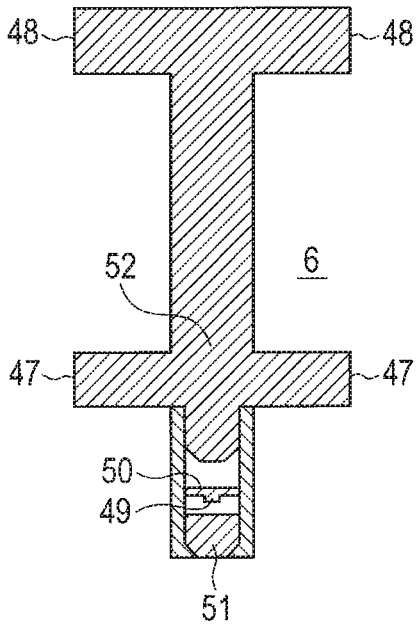
FIG. 4B is a cross-section view of the unit and FIG. 4C is a cross-section view of an LED unit holder.

FIG. 4A is an outside perspective view of the unit 6 and FIG. 4B is a cross-section view of the unit 6. The unit 6 has an LED array (light emitting elements array) as a light emitting device having light emitting elements arrayed in the longitudinal direction of the drum for emitting in accordance with image information to expose the drum in accordance with the image information. The unit 6 also has an LED substrate 50, a SELFOC lens (registered trademark) 51 and a frame member 52. The lens 51 condenses light emitted from the light emitting elements (LEDs) for exposing the drum 1. The frame member 52 has positioning bosses 46 disposed downward at the front side and the back side for positioning the unit 6 and the cartridge P, the guide rail portion 47 functioning as a guide for the cartridge P pushed or pulled and a holding member 48 for holding the unit 6. The bosses 46 at the back side and the front side correspond to the positioning hole 43 and the oblong hole provided for the covers 38 and 39 of the cartridge P. respectively.

Figure 4C:
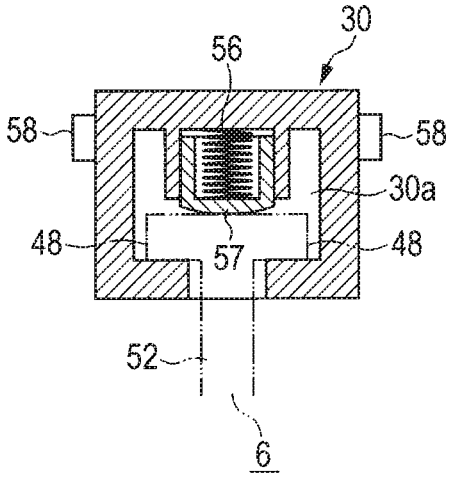

FIG. 4C is a cross-section view of the holder 30. The holder 30 is a member for movably supporting the unit 6 so that the supported unit 6 can be in the exposing position M (FIG. 2B, FIG. 6A) or the retracted position N (FIG. 7C) to which the unit 6 retracts from the exposing position M. At the exposing position M, the light emitting elements of the unit 6 emit and expose the drum 1 via the lens 51. In the embodiment, the holder 30 is a substantially C-shaped groove material facing downward in the cross-section view where the longitudinal direction is the front-back direction. The unit 6 has the holding member 48 engaged in the groove 30*a* of the holder 30 and is supported by the holder 30 movably in the up-down direction. The groove 30*a* of the holder 30 has a spring (elastic member) 56 for urging the supported unit 6 downward and a cap 57 for covering the spring 56. The cap 57 is provided to allow the unit 6 to move (rub) in the holder 30 in the front-back direction of the main body 100A of the apparatus when the holder 30 is raised or lowered. Bosses 58 are provided in left and right portions near the front end and left and right portions near the back end of the holder 30. Two shafts 62 extending in the left-right direction in parallel to each other are provided at the front side and the back side of the main body 100A of the apparatus. The shafts 62 are commonly provided for the first to fourth four cartridge mounted portions 102 (102Y, 102M, 102C, 102K) and rotatably supported between the left side and the right side of the main body frame (not shown) of the apparatus by a bearing member (not shown). The front end of the holder 30 is held to the front side shaft 62 by an arm 61. The base of the arm 61 is fixed to the shaft 62. The bosses 58 at the left and right portions near the front end of the holder 30 are engaged in the holes 61*a* at the tip of the arm 61 and pivoted on the arm. The back side of the holder 30 is also held to the back side shaft 62 by the arm 61. The base of the arm 61 is fixed to the shaft 62. The bosses 58 at the left and right portions near the back end of the holder 30 are engaged in the holes 61*a* at the tip of the arm 61 and pivoted on the arm. The arms 61 at the front side and back side have protrusions 63 to serve as bumpers against the main body frame 109 (FIG. 7B) of the apparatus. The arms 61 at the front side and back side are of the same shape and rotate in the same way.

In the embodiment, the moving member 107 is a mechanism for moving the holder 30 to allow the unit 6 to be in the exposing position M (FIG. 2B, FIG. 6A) or the retracted position N (FIG. 7C) in conjunction with the operation to open and close the door 71 by using a door 71 as an operation member. A toggle lever 64 is fixed to the right end portion of the shaft 62 at the front side. The lever 64 can be postured in two positions that are a first position G (FIG. 6B) and a second position H (FIG. 7B) by a toggle spring 65. The cartridge P is positioned to the image forming position A at the position G. The cartridge P is positioned to a demounting position B (FIGS. 7A and 7B) at the position H. A first gear 68 and a second gear 69 are meshed with each other and pivoted on the main body frame (not shown) of the apparatus. A lever 67 is concentrically fixed to the gear 68. The levers 67 and 64 are connected with each other by a link 66. A lever 70 is concentrically fixed to the gear 69. A boss 70*a* is provided at the tip of the lever 70. A long hole 71*c* is provided for the right side plate 71*b* provided on the inside of the door 71. The boss 70*a* of the lever 70 is engaged with the long hole 71*c*. The long hole 71*c* is also provided for the left side plate 71*b* provided on the inside of the door 71 symmetrically to the right side plate 71*b*. The boss 70*a*, which is provided at the tip of the lever 70 concentrically with the horizontal shaft (hinge shaft) 72 on the left side, is engaged with the long hole 71*c*.

With the above configuration, the unit 6 supported by the holder 30 is moved from the retracted position N to the exposing position M in conjunction with the movement of the door 71 from the opening position F to the closing position E. The unit 6 supported by the holder is also moved from the exposing position M to the retracted position N in conjunction with the movement of the door 71 from the closing position E to the opening position F. The gears 68 and 69 serve to reduce the operating force of the door 71 by a gear ratio in matching the rotational direction of the door 71 and the shaft. The arm 70 serves to reduce the operating force of the door 71 by a lever ratio. The holder 30 serves to move the cartridge P together with the unit 6 in the up-down direction in conjunction with the opening and closing of the door 71, i.e., to move the cartridge P to the image forming position A or the demounting position B in the main body 100A of the apparatus by the operation of the moving member 107.

Figure 5B:
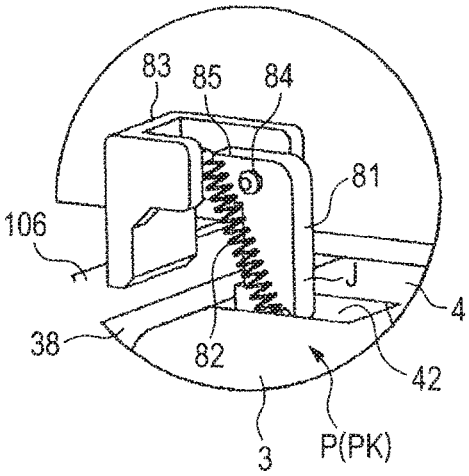
FIG. 5B is a perspective view of a toggle lever that is positioning the process cartridge and FIG. 5C is a perspective view of the toggle lever that is released from the positioning.
Figure 5C:
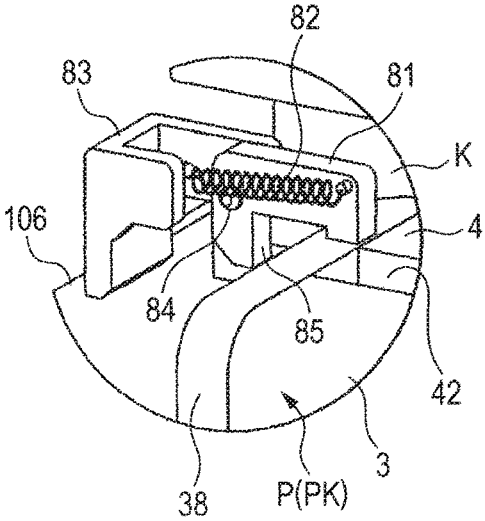

1) Physical relationship between the components in the state that the cartridge P is mounted to the mounted portion 102 and the door 71 is positioned to the closing position E for closing the opening 104 will be described with reference to FIG. 5 and FIG. 6. The toggle lever 81 at the main body 100A side of the apparatus is set in the notch 42 at the cover 38 side (FIG. 5B). In this state, the lever 81 gives the force to the cartridge P to move to the back side main body frame 106 of the apparatus by an urging force of the toggle spring (elastic member) 82. As a result, the bump surface 41 at the cover 38 side is pressed against the inside of the frame 106 and the cartridge P is positioned in the front-back direction in the main body 100A of the apparatus. The lever 81 is attached rotatably about a shaft 84 to a holder 83 that is fixed to the frame 106. The spring 82 is stretched between the holder 83 and the lever 81. The lever 81 can be postured in two positions including a position J for positioning the cartridge and a position K for pushing or pulling the cartridge. The position J is the position for positioning the cartridge where the lever 81 is rotated downward into the hole 42 as shown in FIG. 5B, while the position K is the position for pushing or pulling the cartridge where the lever 81 is rotated forward out from the hole 42 as shown in FIG. 5C.

Downward convexes 36 are provided on the bottom of the cover 38 (one end side) and the bottom of the cover (the other end side) as sections to be positioned (positioning portion of the cartridges). The convex 36 is provided on the same axis line as that of the drum 1 (concentrically with the drum 1). On the other hand, concaves (notches) 37 are provided on stay members (inside plates) 108 at the rear side and front side in the main body 100A of the apparatus as the main body side positioning portions of the apparatus. The convex 36 is pressed against the concave 37. As a result, the cartridge P is positioned to the main body 100A of the apparatus in the left-right direction.

Figure 6B:
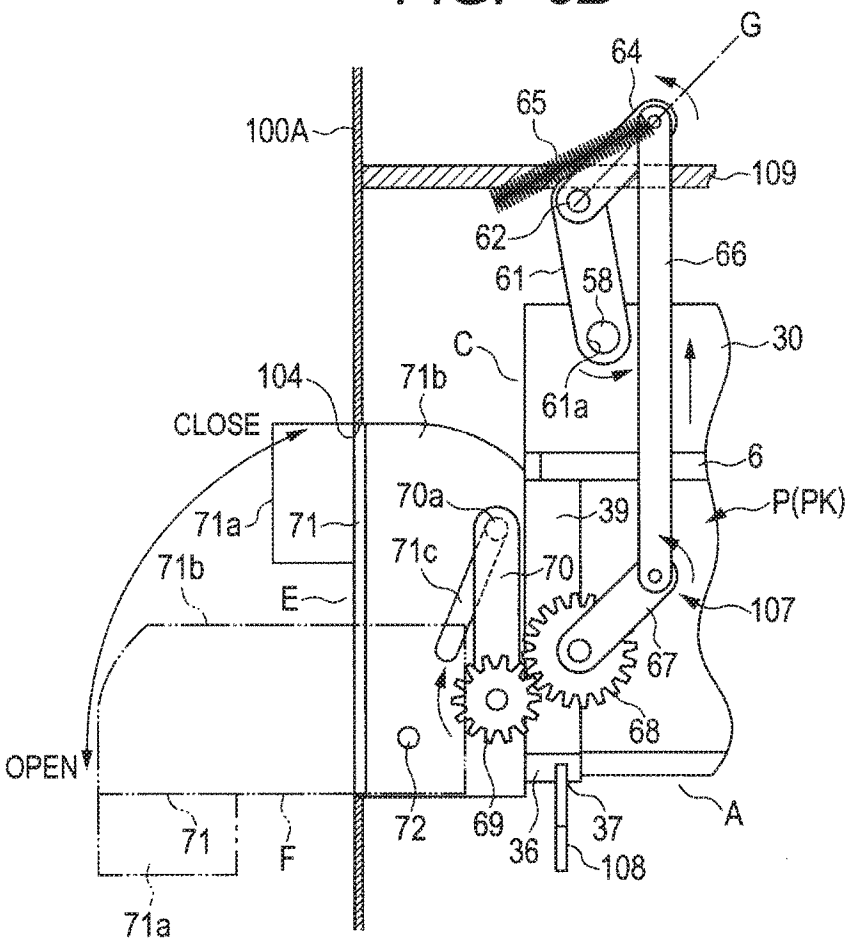
FIGS. 6A and 6B are illustrations of the moving member when the door is closed.

When the door 71 is closed, the lever 70 is rotated to the upright posture by the hole 71*c* and the boss 70*a* as shown in FIG. 6B. As a result, the link 66 is raised by the gears 69, 68 and the lever 67, and the lever 64 is moved to the first position G. When the lever 64 is moved to the position G, the arm 61 comes into the posture of the downward rotation angle and the holder 30 is held to a predetermined descent position C. In this state, the unit 6 is positioned to the cartridge P positioned in the main body 100A of the apparatus. The unit 6 is positioned to the main body of the apparatus in the front-back direction and the left-right direction by the positioning bosses 46 on the unit 6 side engaged with the positioning hole 43 and the oblong hole at the covers 38 and 39 side of the cartridge P. The unit 6 is positioned to the main body of the apparatus in the up-down direction by the bosses 46, the hole 43 and the oblong hole having their bottom bumped. The cartridge P and the unit 6 are pressed by the elastic force of the spring 56 in the holder 30 downward in the main body of the apparatus so as not to rise upward. The cartridge P is held to the image forming position A by the holder 30, the lever 64 and the elastic force of the spring (elastic member) 65 via the arm 61. The door 71 is held to the closing position E by the link 66, the lever 67, the gears 68 and 69 and the arm 70 connected to the lever 64.

Figure 6A:
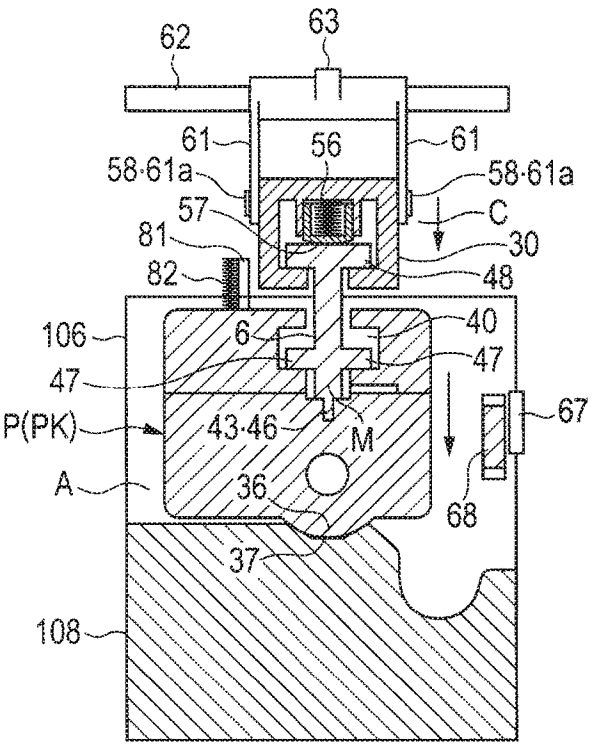
Figure 7B:
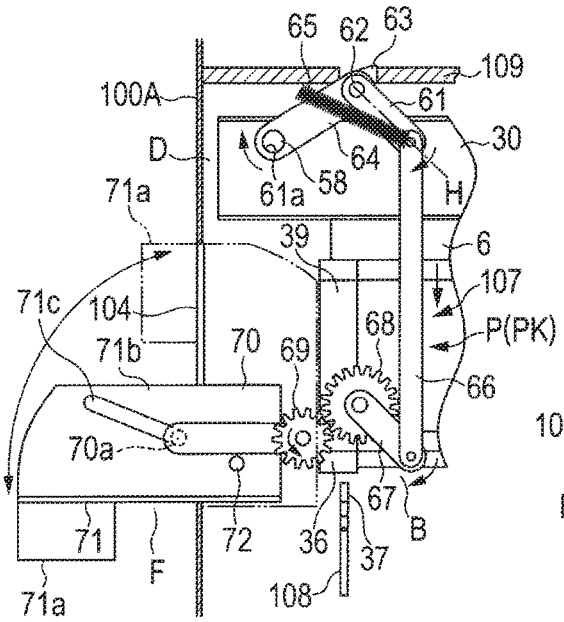
Figure 7C:
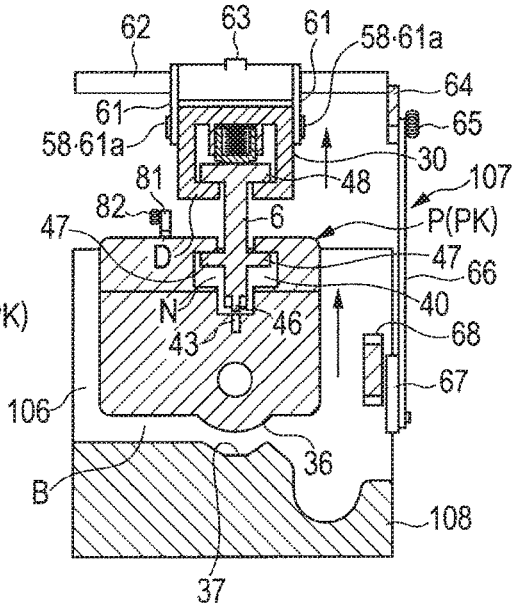

2) Physical relationship between the components in the state that the door 71 is moved from the state shown in FIG. 5 and FIG. 6 to the state at the opening position F for opening the opening 104 with reference to FIG. 7. The lever 70 is rotated from the upright posture to the horizontal posture lowered to the front side as shown in FIG. 7B by the long hole 71*c* and the boss 70*a* in conjunction with the opening rotation of the door 71. As a result, the link 66 is lowered by the gears 69, 68 and the lever 67, and the lever 64 is moved from the first position G to the second position H. The position H of the lever 64 is held by the protrusions 63 bumping against the frame 109. When the lever 64 is moved to the position H, the arm 61 is rotated by about 45° from the downward rotation angle to the user. In this state, the holder 30 is held to the cartridge demounting position D as moved from the descent position C (FIGS. 6A and 6B) by a predetermined amount upward and toward the front. When the holder 30 moves to the cartridge demounting position D, the holding member 48 of the unit 6 is caught by the holder 30 and holds the unit to the upper part of the main body of the apparatus. When the unit 6 moves to the upper part of the main body of the apparatus, the rail portion 47 of the unit 6 is caught by the notched groove portion 40 of the cartridge P and holds the cartridge P upward. In this case, the cartridge P is held as pressed against the frame 106 by the toggle lever 81 placed at the position J for positioning the cartridge. Therefore, the cartridge P moves upward along the inside of the frame 106 but does not move forward. The holder 30 moves from the descent position C to the cartridge demounting position D while sliding toward the holding member 48 of the unit 6. As a result, the unit 6 moves to the retracted position N (FIG. 7C) retracted from the exposing position M (FIG. 2B, FIG. 6A) against the cartridge P. When the unit 6 is in the retracted position N, the positioning bosses 46 at the unit 6 side are out of the positioning hole 43 and the oblong hole at the covers 38 and 39 side. The cartridge P is raised by the unit 6 and moves upward. As a result, the positioning portion of the cartridges 36 are spaced from the positioning portions 37 of the main body of the apparatus to be out of contact with the sections 37. The drum 1 of the cartridge P is spaced from the belt 9 to be out of contact with the belt 9. The position to which the cartridge P is raised is the demounting position B of the cartridge P.

When the cartridge P is moved to the demounting position B, the user can pull the cover 39 side of the cartridge P toward the user to draw the cartridge P out from the opening 104 toward the user along the rail portion 47 of the unit 6. At the beginning of the pulling process of the cartridge P toward the user, the notch 42 moves forward, rotating the toggle lever 81 to the upper part of the main body of the apparatus, resisting the tension of the toggle spring (elastic force) 82. When the dead point is passed, the cartridge P is held in the state as it is changed to the position K for pushing or pulling the cartridge where the lever 81 is rotated forward out from the hole 42 as shown in FIG. 5C. The cartridge P is further pulled outside from the opening 104 along the rail portion 47 of the unit 6 and smoothly pulled toward the user on a front-back direction rib 73 inside the door 71 which is held open to a substantially horizontal state.

3) In order to push the cartridge P in the main body 100A of the apparatus, the cartridge P is placed on the rib 73 inside the door 71 which is held open to a substantially horizontal state with the cover 38 side inside. As the cartridge P is inserted into the main body 100A of the apparatus from the opening 104, the rail portions 47 of the unit 6 which are held in the holder 30 positioned at the cartridge demounting position D correspondingly enter the notched groove portions 40 of the cover 38. As the cartridge P is further pushed, the cartridge P is guided by the rail portion 47 into the main body 100A of the apparatus. At the end of the pushing process, the cover 38 bumps against a sub lever portion 85 of the toggle lever 81 which is changed to and held in the position K for pushing or pulling the cartridge (FIG. 5C). As a result, the lever 81 is rotated to the lower part of the main body of the apparatus, resisting the tension of the toggle spring 82. When the dead point is passed, the lever 81 is moved to the position J for positioning the cartridge where the lever 81 is rotated downward into the hole 42 as shown in FIG. 5B. That is, the cartridge P comes into the state that it is positioned to the main body 100A of the apparatus in the front-back direction as the bump surface 41 at the cover 38 side is pressed against the inside of the frame 106 by the lever 81 that is moved to the position J.

Then, the door 71 is rotated from the opening position F to the closing position E for closing the opening 104. The lever 70 is rotated from the posture lowered to the front side by the long hole 71*c* and the boss 70*a* to the upright posture as shown in FIG. 6B in conjunction with the closing rotation of the door 71. As a result, the link 66 is raised by the gears 69, 68 and the lever 67, and the lever 64 is moved from the second position H shown in FIG. 7B to the first position G shown in FIG. 6B. When the lever 64 is moved to the position G, the arm 61 comes into the posture of the downward rotation angle and the holder 30 is held to a predetermined descent position C. In this state, the unit 6 and the cartridge P are lowered. The cartridge P moves from the demounting position B to the image forming position A and the positioning portion of the cartridges 36 are engaged with the positioning portions 37 of the main body of the apparatus. The unit 6 is positioned as it moves from the retracted position N to the exposing position M to the cartridge P and the unit 6 side positioning bosses 46 are engaged with the positioning hole 43 and the oblong hole at the side of the covers 38 and 39 of the cartridge P. The unit 6 is positioned to the main body in the up-down direction by the positioning bosses 46 and the hole 43 having their bottom bumped. The cartridge P and the unit 6 are pressed by the spring 56 in the holder 30 downward in the main body of the apparatus so as not to rise upward. The cartridge P is held to the image forming position A by the holder 30, the toggle lever 64 and the toggle spring 65 via the arm 61. That is, the cartridge P is positioned to the image forming position A in conjunction with the movement of the holder 30 by the moving member 107 to position the unit 6 at the exposing position M. The door 71 is held to the closing position E by the link 66, the lever 67, the gears 68 and 69, and the arm 70 connected to the toggle lever 64. That is, the physical relationship between the components returns to that in the state that the cartridge P is mounted to the mounted portion 102 and the door 71 is positioned at the closing position E for closing the opening 104 as shown in FIGS. 5 and 6.

The other cartridges PY, PM and PC and the corresponding mounted portions 102Y, 102M and 102C operate in the same way as described above.

As described above, the cartridge P is inserted into or pulled out from the main body 100A of the apparatus in the longitudinal direction of the drum 1 along the unit 6 positioned at the retracted position N. The cartridge P is positioned at the image forming position A to contribute to the image formation on the belt 9 in conjunction with the movement of the holder 30 by the moving member 107 to position the unit 6 at the exposing position M. The unit 6 is positioned at the exposing position M and the cartridge P is positioned at the image forming position A by the elastic force of the spring 65 of the holder 30. In the embodiment, the cartridge P has the positioning portion of the cartridges 36 provided on the same axis line as that of the drum 1 (concentrically with the drum 1) at one end and the other end of the drum 1 in the longitudinal direction. The main body 100A of the apparatus has the positioning portions 37 of the main body of the apparatus for positioning the positioning portion of the cartridges 36 and positions the unit 6 at the exposing position M by pressing the unit 6 against the cartridge P with the elastic force of the spring 56. The main body 100A of the apparatus also positions the cartridge P at the image forming position A by pressing the positioning portion of the cartridges 36 against the positioning portions 37 of the main body of the apparatus with the elastic force of the spring 56.

Guiding of the cartridge P in the unit 6 can improve the usability of the apparatus for the user pushing in and pulling out the cartridge. Raising and lowering of the cartridge P and the unit 6 can contribute to accurate positioning of the cartridge P and the unit 6 in the main body 100A of the apparatus.

Embodiment 2

The feature of Embodiment 2 is that the holder 30 has a rail portion 59 for guiding the cartridge P. That is, the holder 30, the light emitting device unit supporting member, has the light emitting device unit supporting member side guide portion 59 for guiding the cartridge P inserted into or pulled out from the main body 100A of the apparatus. The holder 30 is characterized by guiding the cartridge P while the unit 6 is at the retracted position N.

The same members and components as those in Embodiment 1 are denoted by the same reference characters and omitted from the description below. In this embodiment, the cartridge P has two guide bosses 44 at each of the left side and right side of the back side cover 38 and the front side cover 39 as shown in FIG. 8A. The bosses 44 function as cartridge side guide portions for a inserted into or pulled out cartridge P. The holder 30 has the guide rail portions 59 as the light emitting device unit supporting member side guide portion to be engaged with the guide bosses 44 at the cartridge P side as shown in FIG. 8B. The rail portions 59 function as guides for the inserted into or pulled out cartridge P.

Figure 8C:
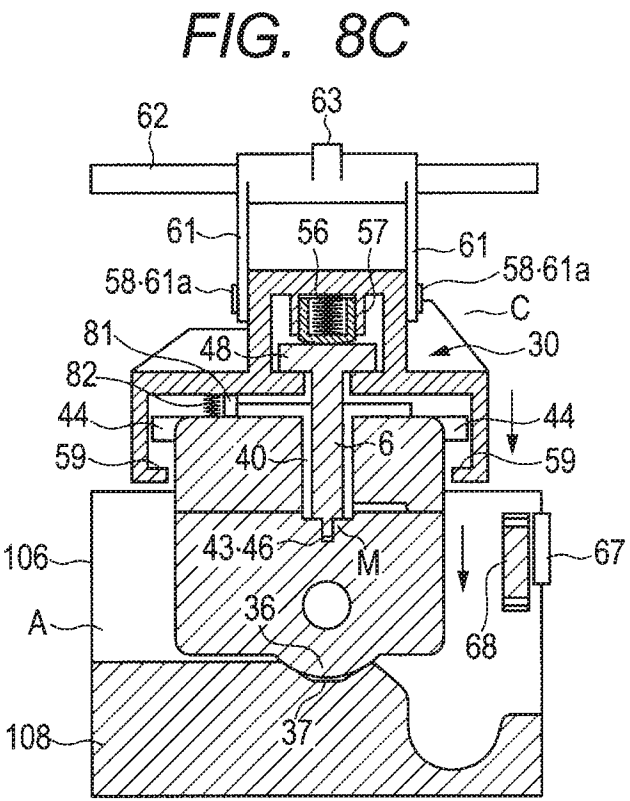
FIGS. 8A, 8B and 8C are illustrations of a principal part of the electrophotographic image forming apparatus.
Figure 8A:
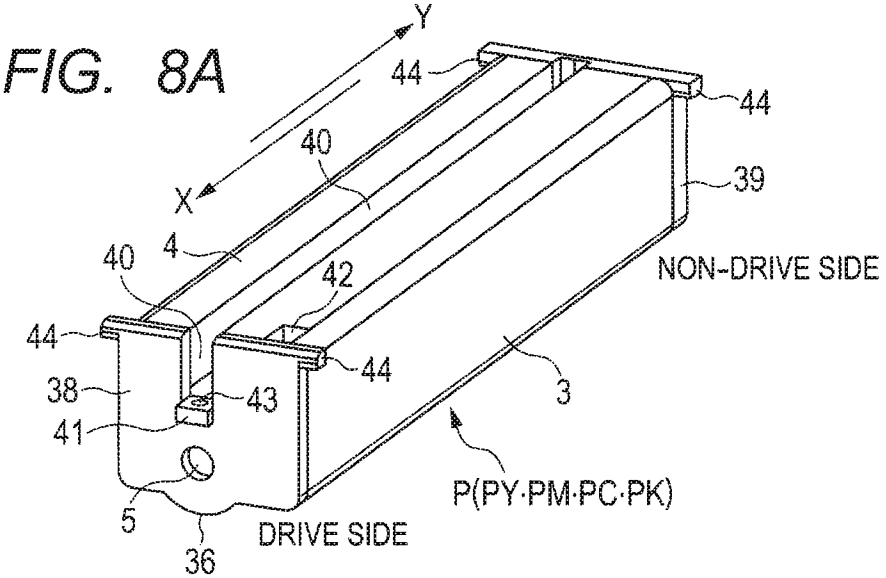
Figure 8B:
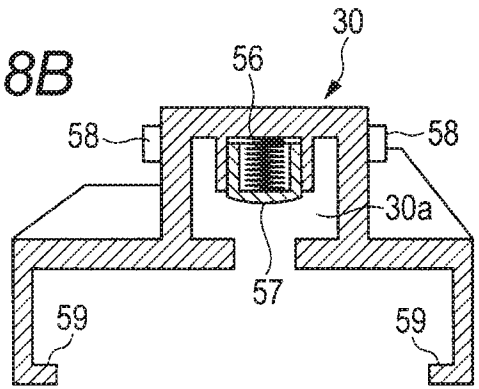

FIG. 8C is an illustrations of physical relationship between the components in the state that the cartridge P is mounted to the mounted portion 102 and the door 71 is positioned to the closing position E for closing the opening 104. As in the state of the apparatus according to Embodiment 1 shown in FIG. 6A, the holder 30 is positioned to the descent position C, and the cartridge P is held as positioned to the image forming position A and the unit 6 is to the exposing position M. In this state, the apparatus 100 can perform the image forming operation.

Figure 9A:
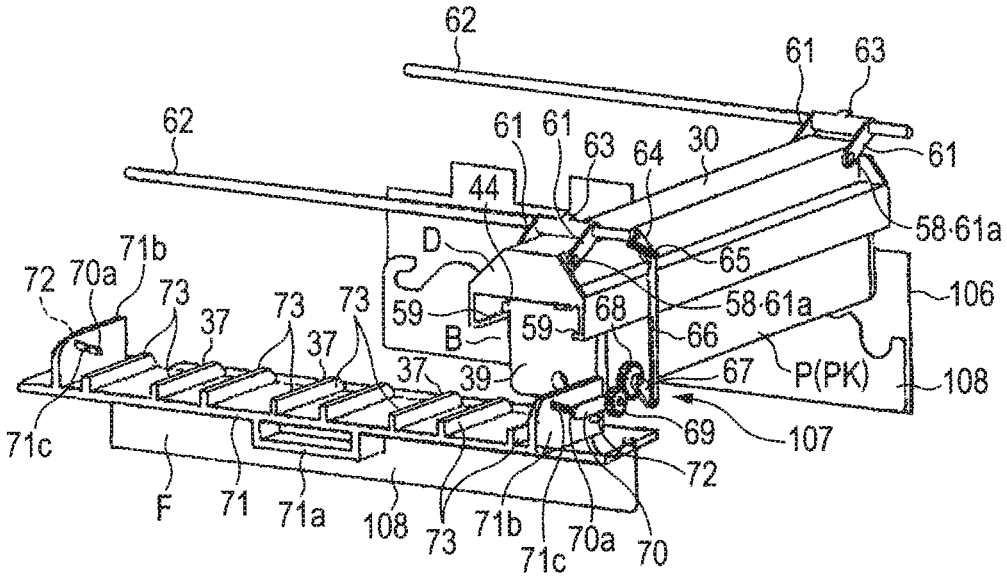
FIGS. 9A and 9B are illustrations of the principal part of the same apparatus.
Figure 9B:
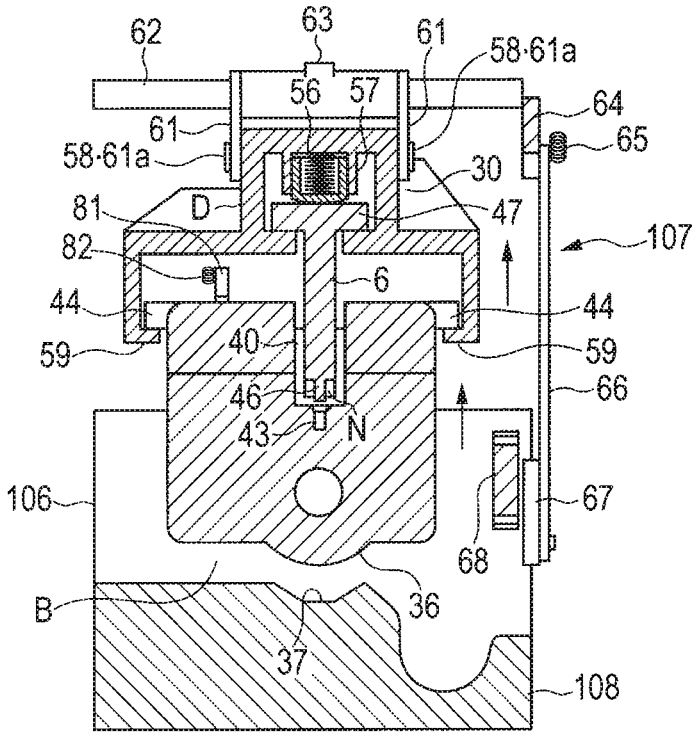

FIGS. 9A and 9B are illustrations of physical relationship between the components in the state that the door 71 is moved to the opening position F for opening the opening 104, corresponding to FIGS. 7A and 7C respectively as in the state of the apparatus according to Embodiment 1 shown in FIG. 6A. Same as the apparatus according to Embodiment 1, the apparatus according to the embodiment has the holder 30 held to the cartridge demounting position D as moved from the descent position C by a predetermined amount upward and toward the front in conjunction with the opening rotation of the door 71. As a result, the unit 6 moves as raised from the exposing position M to the retracted position N to the cartridge P. In the embodiment, when the unit 6 moves to the upper part of the main body of the apparatus, the guide rail portions 59 at the holder 30 side catch the guide bosses 83 at the cartridge P side and moves the cartridge P upward. That is, the cartridge P moves from the image forming position A to the cartridge demounting position B. As with the apparatus according to Embodiment 1, when the cartridge P is moved to the demounting position B, the user can pull the front side cover 39 of the cartridge P toward the user to draw the cartridge P out from the opening 104 toward the user along the rail portions 47 of the holder 30.

Same as the apparatus according to Embodiment 1, in order to push the cartridge P in the main body 100A of the apparatus, the cartridge P is placed on the rib 73 inside the door 71 which is held open to a substantially horizontal state with the back side cover 38 inside. As the cartridge P is inserted into the main body 100A of the apparatus from the opening 104, the guide bosses 44 at the back side of the cartridge P are engaged with the rail portions 59 of the holder 30 which is positioned at the cartridge demounting position D. As the cartridge P is further pushed, the rail portions 47 of the unit 6 which is held in the holder 30 correspondingly enter the notched groove portions 40 of the cover 38. As the cartridge P is further pushed, the cartridge P is guided by the rail portions 59 into the main body 100A of the apparatus. At the end of the pushing process, the guide bosses 44 at the front side of the cartridge P are engaged with the rail portions 59 of the holder 30. Same as the apparatus according to Embodiment 1, when the cartridge P is pressed against the inside of the frame 106 by the toggle lever 81, the cartridge P is positioned to the main body 100A of the apparatus in the front-back direction. Then, the door 71 is rotated from the opening position F to the closing position E for closing the opening 104. In conjunction with the closing rotation of the door 71, the holder 30 is moved from the cartridge demounting position D to the descent position C by the moving member 107. As a result, the physical relationship between the components returns to that in the state that the cartridge P is positioned at the image forming position A and the unit 6 is positioned at the exposing position M as shown in FIG. 8C.

As in Embodiment 2, guiding of the cartridge P by the holder 30 can improve the usability of the apparatus for the user pushing in and pulling out the cartridge. Raising and lowering of the cartridge P and the unit 6 can contribute to accurate positioning of the cartridge P and the unit 6 in the main body 100A of the apparatus.

Embodiment 3

Figure 10A:
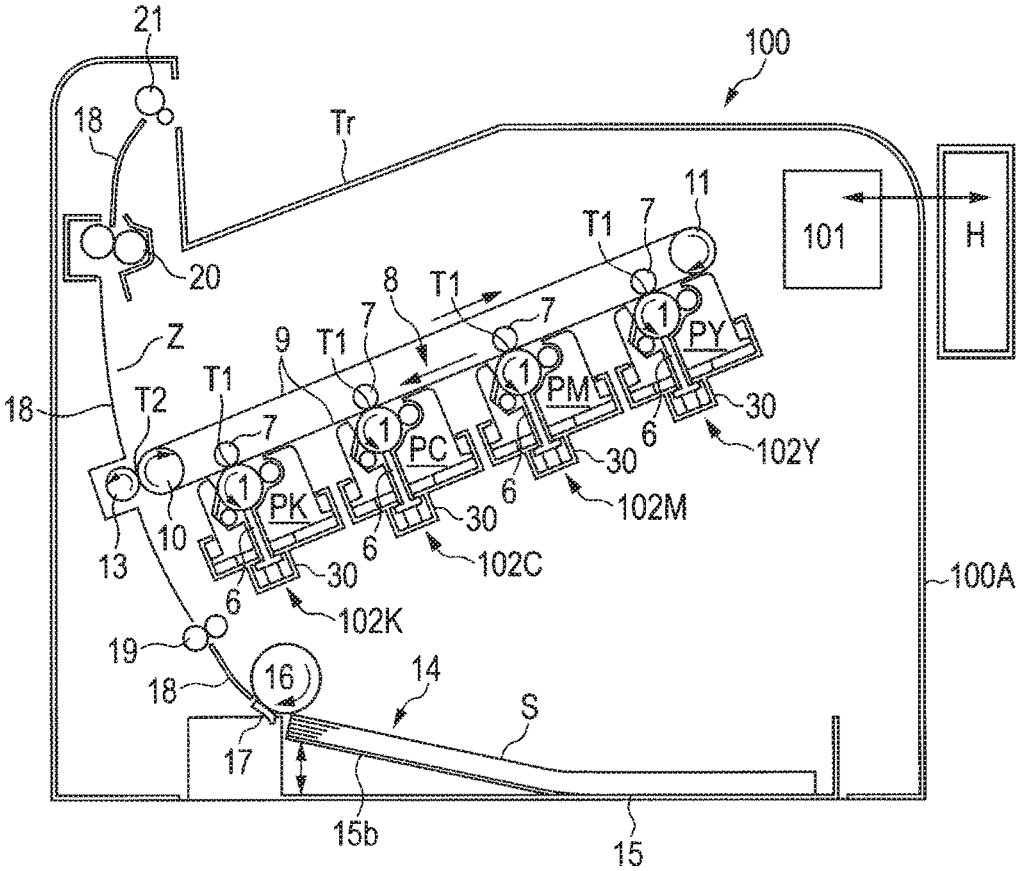
FIGS. 10A and 10B are illustrations of the electrophotographic image forming apparatus.

Embodiment 3 is an apparatus 100 having an intermediate transfer belt unit 8 positioned over the cartridge mounted portion 102 as shown in FIG. 10A. The apparatus according to this embodiment is characterized in that the holder 30 has rail portions for guiding the cartridge P as the apparatus according to Embodiment 2. The same members and components as those in Embodiment 1 and Embodiment 2 are denoted by the same reference characters and omitted from the description below. An image forming operation by the apparatus 100 according to this embodiment is the same as that by the apparatus 100 according to Embodiment 1. The cartridge P and the unit 6 basically have the same configurations as those of the Embodiment 2.

Figure 10B:
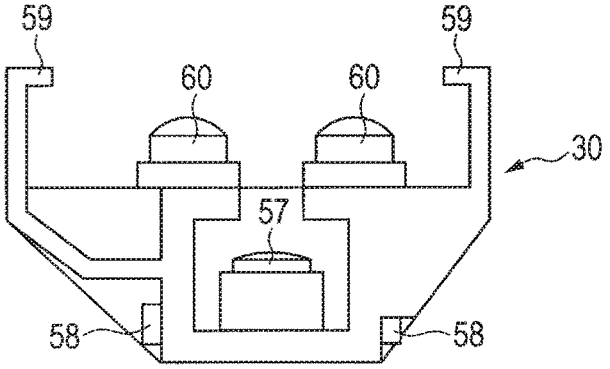

The holder 30 holding the unit 6 shown in FIG. 10B has upper caps 60 for urging the cartridge P upward and a lower cap 57 for urging the unit 6 upward. Although not shown in the figure, the caps 60 and 57 have the springs (elastic members) 56 as in Embodiment 2. When the cartridge P is inserted into or pulled out from the apparatus, the upper caps 60 raise the cartridge P to prevent it from interfering with the unit 6. The guide rail portions 59 serve as upward regulation guides for the cartridge. The holder 30 has bosses 58 at four places held by the arm 61 in the front and back two places of the main body 100A of the apparatus.

Figure 11B:
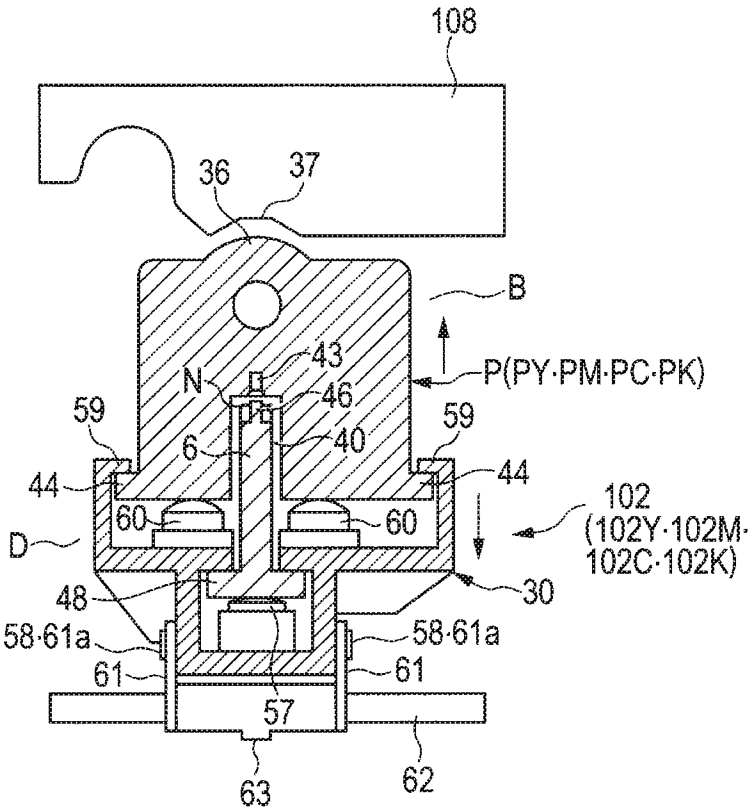
FIGS. 11A and 11B are diagrams for describing operations of the principal part of the same apparatus.
Figure 11A:
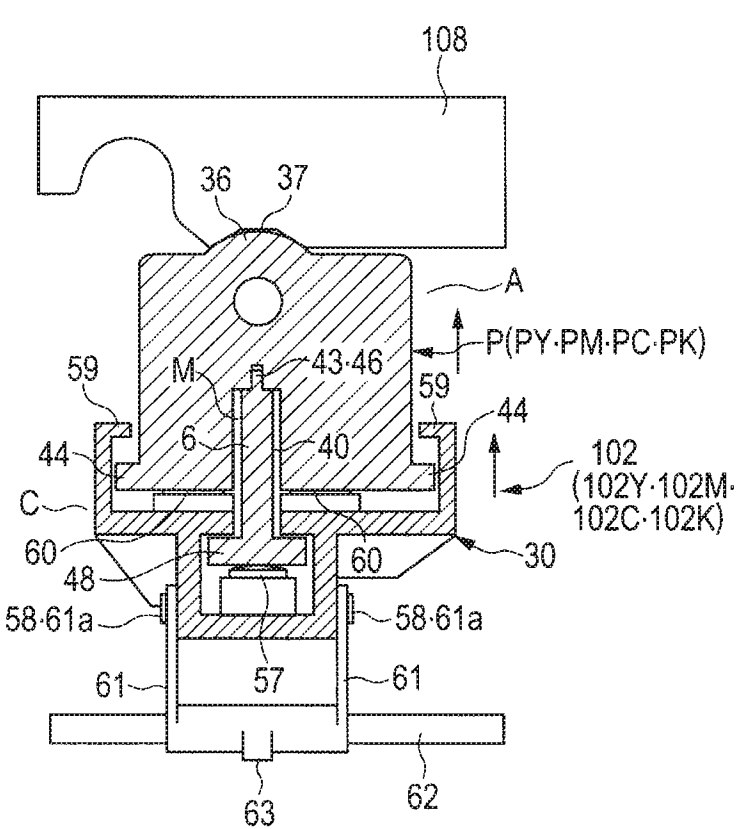

As shown in FIG. 11A, the arms 61 are held to the main body 100A of the apparatus by the shaft 62 supported by the main body frame of the apparatus in the front and back two places of the main body 100A of the apparatus. The arms 61 have the protrusions 63 and serve as bumpers against the main body frame of the apparatus. The end surfaces of the shaft 62 have the toggle arms 64 fixed thereto and have a first position where the cartridge P is positioned to the image forming position A and a second position where the cartridge P is positioned to the demounting position B by the toggle spring 65. Together with the unit 6, the holder 30 serves to move the cartridge P in the up-down direction (to the image forming position A and to the demounting position B). The holder 30 is moved in the up-down direction by the moving member 107 in conjunction with the door 71. Since the moving member 107 denotes basically the same as that in Embodiments 1 and 2, it is omitted from the description below.

FIG. 11A shows physical relationship between the components in the state that the cartridge P is mounted to the mounted portion 102 and the door 71 is positioned to the closing position for closing the opening. In this state, the holder 30 is at the upper part as moved by the moving member 107. As a result, the cartridge P has the positioning portion of the cartridge 36 pressed by the main body side positioning portion 37 and positioned and held to the image forming position A with the elastic force of the spring (not shown) in the cap 60. The unit 6 is pressed by the cartridge P and positioned and held to the exposing position M with the elastic force of the spring (not shown) in the cap 57.

FIG. 11B shows physical relationship between the components in the state that the door 71 is in the opening position for opening the opening. The holder 30 is at the lower part as moved by the moving member 107. When the holder 30 is moved below in the main body of the apparatus by the moving member 107 in conjunction with the opening of the door, the cartridge P is moved upward to the point where the guide bosses 44 bump against the upward regulation guide 59. As a result, the positioning bosses 46 of the unit 6 are spaced from the positioning hole 43 of the cartridge p to be in the retracted position N, allowing the cartridge P to be pulled out. The cartridge P is moved to the demounting position B. In this state, the cartridge P can be guided by the guide portion 59 of the holder 30 to the front side of the main body of the apparatus to be pulled out from the apparatus.

In order to push the cartridge P in the main body 100A of the apparatus, the cartridge P is placed on the rib 73 inside the door 71 which is held open, and inserted into the main body of the apparatus. At first, the cartridge P is slightly raised by the spring in the cap 60 that is disposed in front of the rail portions 59 of the holder 30. The entrances of the rail portions 59 of the holder 30 are tapered to invite the bosses 44. When the cartridge P is inserted into the main body 100A of the apparatus, the bosses 44 are invited in the rail portions 59 and the cartridge P is inserted with the bosses 44 bumped against the guide ribs (not shown). Finally, the end surface of the cartridge comes into contact with the toggle lever 81 disposed at the back side of the main body of the apparatus, brings the lever 81 down to be pulled into the main body of the apparatus with the pulling force of the spring 82. As a result, the cartridge P is positioned to the main body 100A of the apparatus in the front-back direction as the bump surface 41 of it comes into contact with the main body frame 106 of the apparatus. Then, the door 71 is rotated from the opening position to the closing position for closing the opening. The holder 30 is raised from the demounting position to the upper position C by the moving member 107 in conjunction with the closing rotation of the door 71. As a result, the physical relationship between the components returns to that shown in FIG. 11A where the cartridge P is positioned and held to the image forming position A and the unit 6 is to the exposing position M.

Guiding of the cartridge P by the holder 30 as described above can improve the usability of the apparatus for the user pushing in and pulling out the cartridge. Raising and lowering of the cartridge P and the unit 6 can contribute to accurate positioning of the cartridge P and the unit 6 in the main body 100A of the apparatus.

Embodiment 4

Figure 12B:
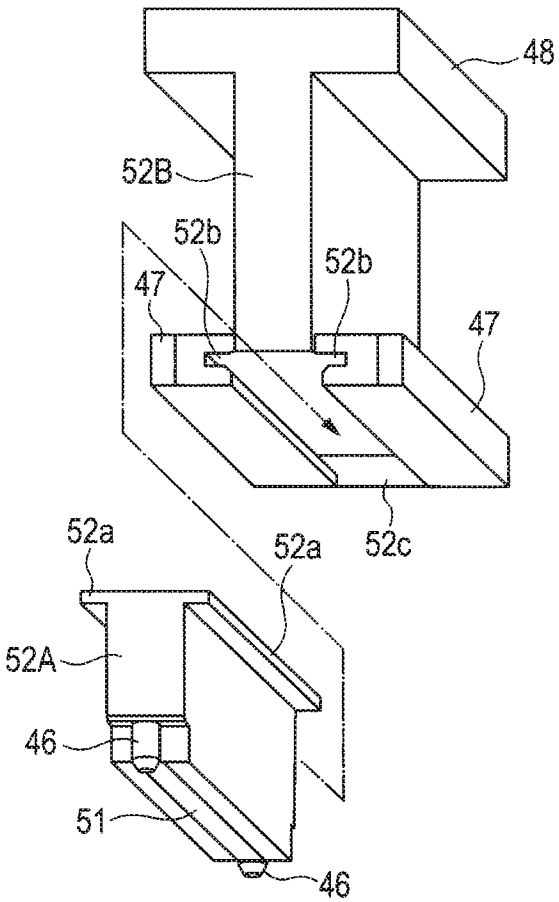
FIGS. 12A and 12B are illustrations of the LED unit.
Figure 12A:
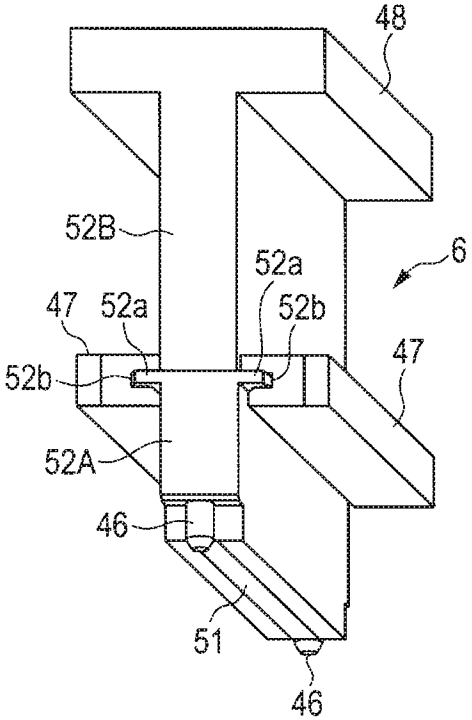

Embodiment 4 is the unit 6 in the apparatus according to Embodiment 1 of a configuration other than those shown in FIG. 4A and FIG. 4B. FIG. 12A and FIG. 12B are illustrations of the unit 6. The unit 6 according to this embodiment separates the frame member 52 into two frame members, a first member 52A and a second member 52B and joins the frame members 52A and 52B to be the unit 6. The first frame member 52A is provided with the LED substrate 50, the SELFOC lens 51 and the positioning bosses 46 disposed downward at the front side and back side for positioning the cartridge P. The first frame member 52A is provided with the guide rail portions 47 serving as the guide for the pushing in or pulling out cartridge P and the holding member 48 for holding the unit 6. The first frame member 52A is provided with tongue portions 52*a* along the longitudinal direction. The second frame member 52A is provided with a groove portion 52*b* along the longitudinal direction to be engaged with the tongue portions 52*a*. The back end of the tongue portions 52*a* of the first frame member 52A is correspondingly engaged with the front end of the groove portion 52*b* of the second frame member 52B. Then, the first and second frame members 52A and 52B are relatively slid in the longitudinal direction. They are slid until the first frame member 52A bumps against a stopper 52*c* at the back end of the second frame member 52B. As a result, the first and second frame members 52A and 52B are joined to form the unit 6. The tongue portion 52*a* may be provided at the second frame member 52B side and the groove portion 52*b* may be provided at the first frame member 52A side.

Although the door 71. is used as an operation member for the moving member 107 in the apparatuses according to Embodiments 1 to 3, the operation member may be another member that is operated independent of the door 71. For example, the lever 70 is used as the operation member to be directly operated by the user. When the lever is designed as an independent member that does not function in conjunction with the door 71, the cartridge P can be held in the demounting position as in the operations of the above embodiments by opening the door 71 and rotating the lever 70.

As the light emitting elements of the light emitting device 6, electroluminescence elements such as liquid crystal devices, semiconductor light-emitting diodes, organic electroluminescence devices (organic EL devices) are used. The semiconductor light-emitting diode is a semiconductor device that emits when a voltage is applied. The organic EL device is self-luminous and includes an electronic material made of organic compounds that emit when a voltage is applied. As an example of the organic EL devices, an organic molecular luminescent layer is sandwiched by two electrodes and a voltage is applied therebetween. Then, the electrons injected by the electrodes recombine with positive holes to excite the organic molecules, and when the excited organic molecules return to the ground state, the organic EL devices emits.

The above embodiments are examples of an in-line type color printer, but the same effects can be obtained by a configuration of mono-color printer.

Embodiments 1 to 4 have been described above, and now, Embodiments 5 to 8 will be described below.

In Embodiments 1 to 4, the configurations in which the light emitting device having light emitting elements or the supporting member supporting the light emitting device functions as a guide for the cartridge P have been described; in Embodiments 5 to 8, the configurations of the guide for the cartridge P having further features will be described.

Embodiment 5

[Brief Configuration of Exemplary Electrophotographic Image Forming Apparatus]

Figure 13A:
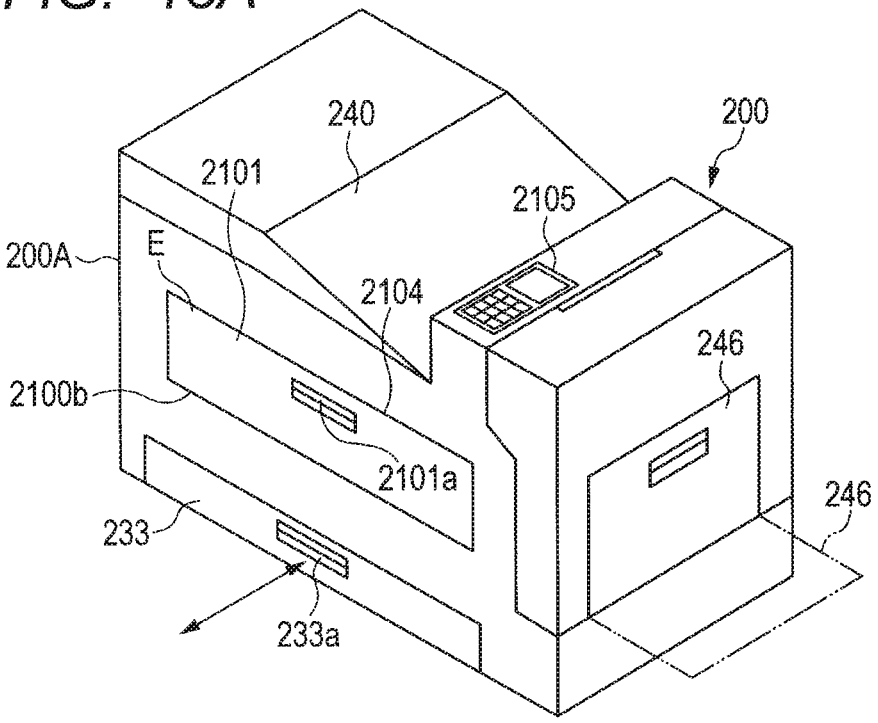
FIG. 13A is an outside perspective view of the electrophotographic image forming apparatus and FIG. 13B is an outside perspective view of the same apparatus with a front door opened for one of process cartridges pulled out from or inserted into the mounted portion in the main body of the apparatus.
Figure 13B:
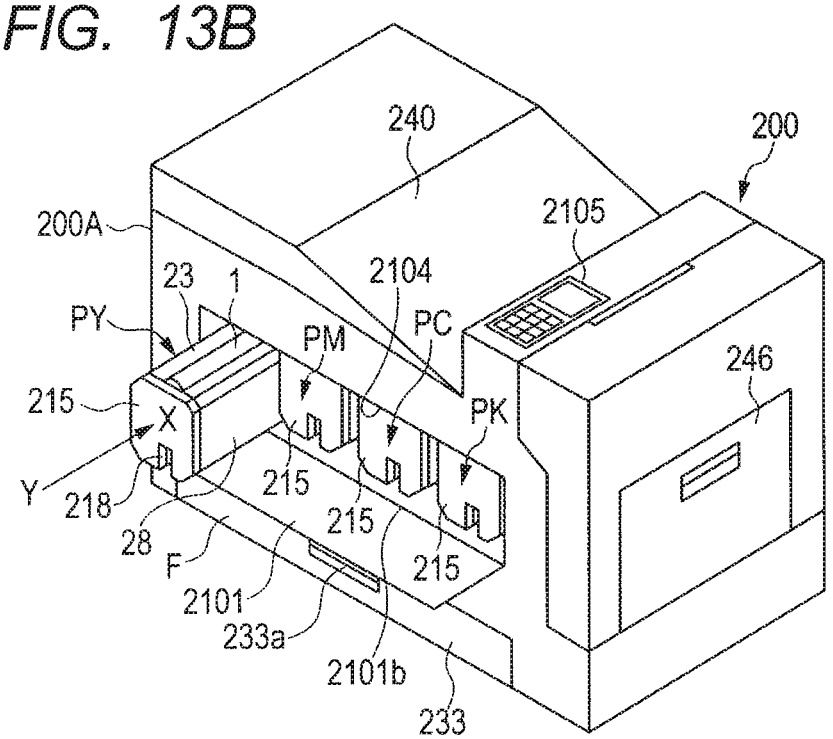
Figure 14A:
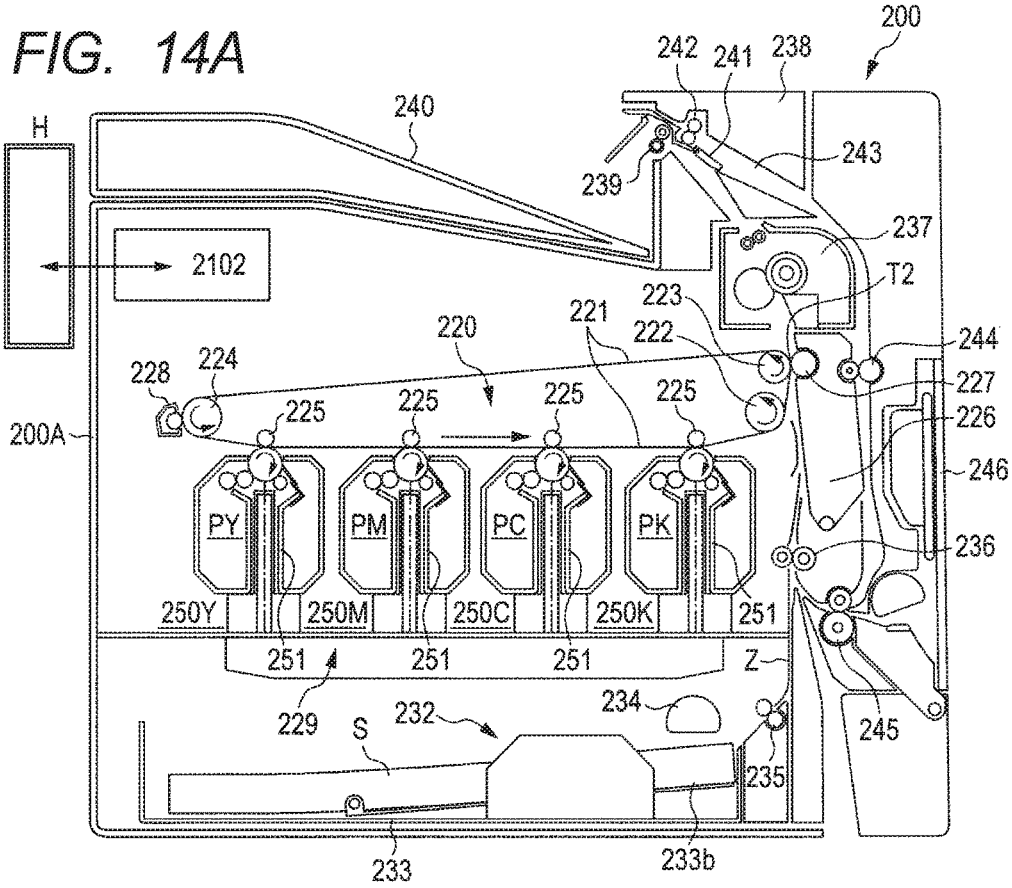
FIG. 14A is a longitudinal sectional front view of the electrophotographic image forming apparatus and FIG. 14B is a partial enlarged view of the electrophotographic image forming apparatus shown in FIG. 14A.
Figure 14B:
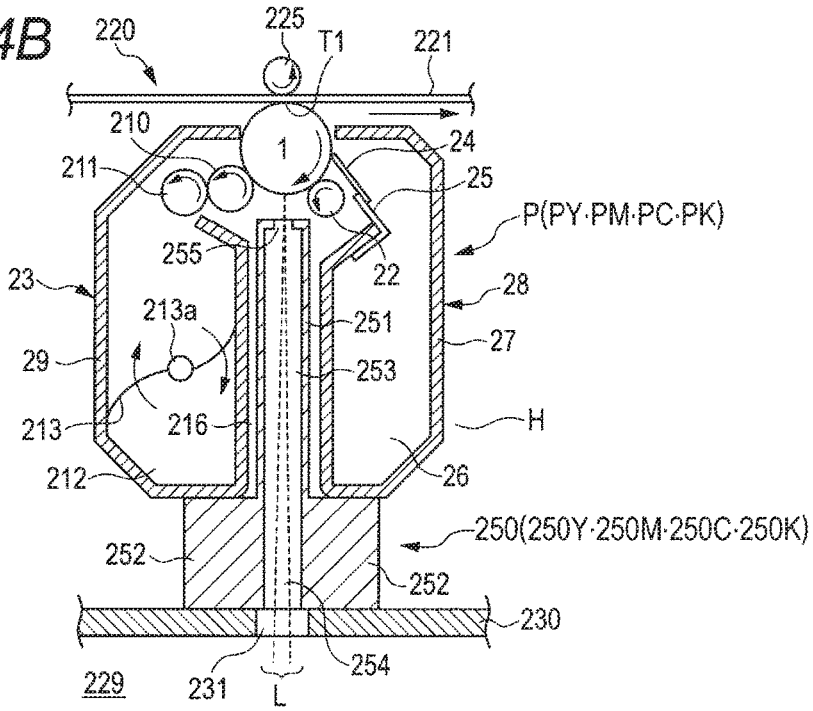
Figure 15A:
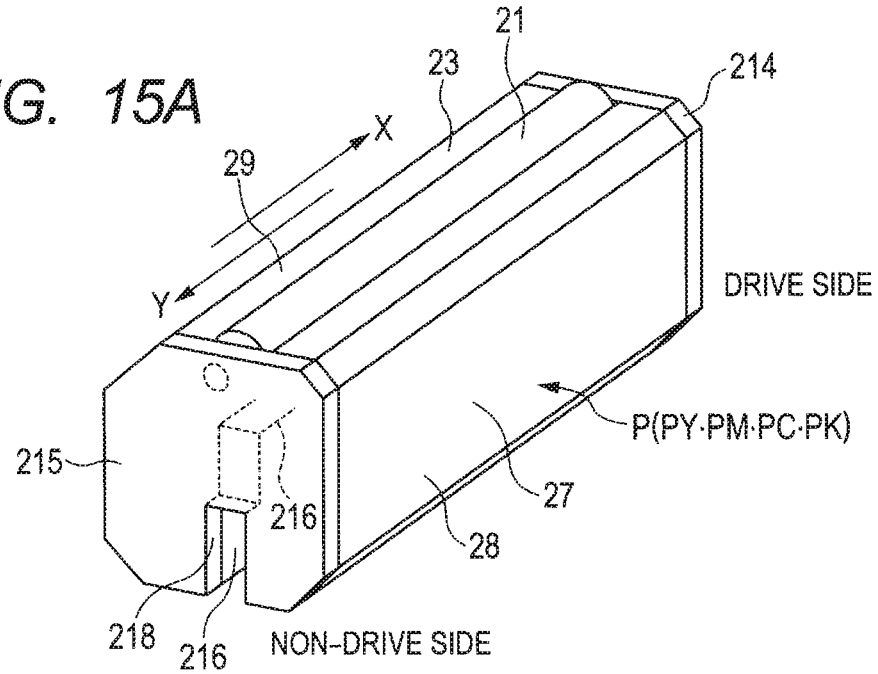
FIG. 15A is an outside perspective view of the process cartridge from the viewpoint of the non-driven side and FIG. 15B is an outside perspective view of the process cartridge from the viewpoint of the driven side.
Figure 15B:
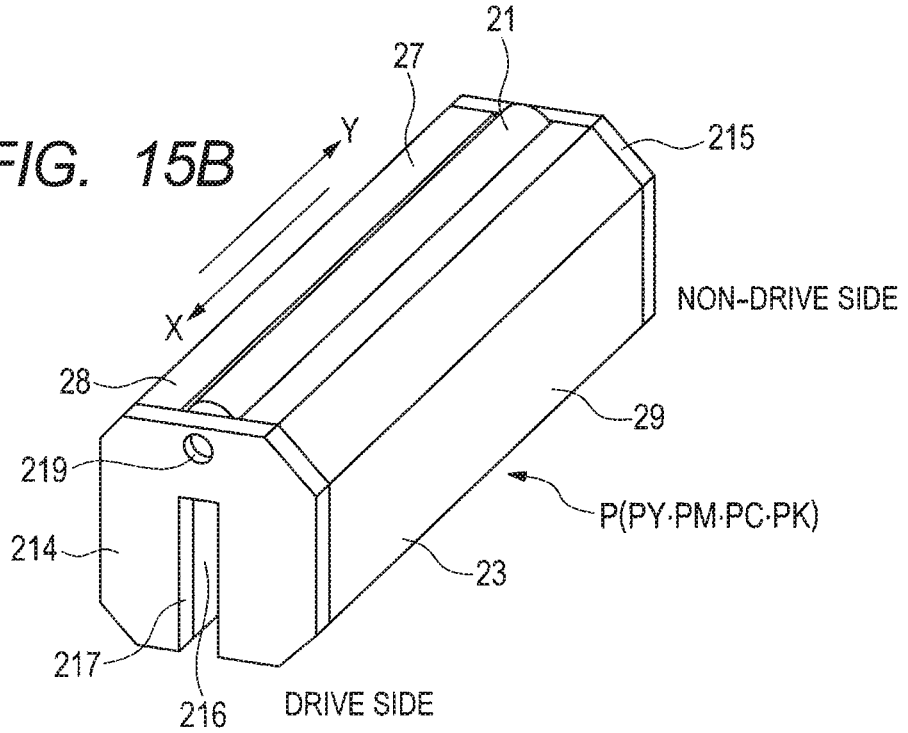

FIG. 13A is an outside perspective view of the electrophotographic image forming apparatus 200 according to Embodiment 5 and FIG. 13B is an outside perspective view of the apparatus 200 with a front door 2101 opened for one of process cartridges pulled out from or inserted into the mounted portion in the main body 200A of the apparatus. FIG. 14A is a longitudinal sectional front view of the apparatus 200 and FIG. 14B is a partial enlarged view of FIG. 14A. FIG. 15A is an outside perspective view of the process cartridge P from the viewpoint of the non-driven side and FIG. 15B is the same from the viewpoint of the driven side. The apparatus 200 is an in-line type color electrophotographic image forming apparatus of intermediate transfer type for forming a color image on a recording medium with four process cartridges, each having a photosensitive drum, detachably mounted to a mounted portion in the main body 200A of the apparatus respectively. For an exposure device for exposing the drum, a laser scanner unit is used. More specifically, the apparatus 200 is a full-color (four color) laser beam printer using an electrophotographic process. The printer forms a color image on a sheet of recording medium (hereinafter referred to as 'recording material') S based on an electric image signal input from the host device H such as a PC and an image reader to the control circuit portion 2102.

In the description below, the 'front side' (frontal side) refers to the side where a door (front door) 2101 for opening and closing the apparatus is provided. The 'back side' (rear side) refers to the side opposite to the front side. The 'front-back direction' refers to the direction from the back side to the front side of the apparatus (frontward) and the direction opposite to the frontward direction (i.e., rearward). The 'left and right' refers to left and right viewed from the front side of the apparatus. The 'left-right direction' refers to the direction from right to left (leftward direction) and the direction opposite to the leftward direction (i.e., rightward direction). The 'up and down' refers to up and down in the gravity direction. The 'main body 200A' of the apparatus refers to the portion of the apparatus 200 excluding the cartridges P.

The main body 200A of the apparatus has first to fourth four process cartridge mounted portions 250 (250Y, 250M, 250C, 250K) placed substantially horizontally from the left side to the right side. The first to fourth four cartridges P (PY, PM, PC, PK) are detachably mounted to the mounted portions 250, respectively. Each of the mounted portions 250 has a guide portion (guide means) 251 for guiding the process cartridge P inserted into and pulled out from the main body 200A of the apparatus. The guide portion 251 will be described later.

The cartridges P are the same electrophotographic process mechanism except for colors of contained toner. The cartridge P of the embodiment has a drum unit 28 and a developing unit (developing device) 23, and the units 28 and 23 are integrated into a cartridge with a predetermined physical relationship between a back side cover member 214 and a front side cover member 215.

The unit 28 has the photosensitive drum 1, and a charging device 22 and a cleaning device 24 as process devices acting on the drum 1 attached with a predetermined physical relationship to a frame 27 as a first frame member. The drum 1 is rotatably supported by bearings (not shown) at one side and the other side to the frame 27. The charging device 22 is means for uniformly charging the surroundings of the drum 1 to predetermined polarity and electric potential by using the charge roller in this embodiment. The charge roller 22 is disposed substantially in parallel with the drum 1 and rotatably supported by bearings (not shown) at one side and the other side to the frame 27. The charge roller 22 is in contact with the drum 1 with a predetermined pressure and rotates following to the rotation of the drum 1. The cleaning device 24 is means for removing transfer residual toner from the surface of the drum after a primary transfer of a toner image onto an intermediate transfer belt 221, an intermediate recording medium to be described later, and an elastic cleaning blade is used in this embodiment. The blade 24 is disposed with a sheet metal 25 supporting the base of the blade 24 fixed to the frame 27 and the tip of the blade in contact with a counter in the rotational direction to the drum 1. The frame 27 has a residual toner container 26 inside.

The unit 23 has a toner roller 210 and a toner supply roller 211 attached with a predetermined physical relationship with each other to a developing frame 29 as a second frame member portion. The roller 210 is a developing member for developing an electrostatic latent image formed on the drum 1 as a toner image by supplying the toner to the drum 1. The roller 210 is disposed in parallel with the drum 1 either in contact with or not in contact with the drum 1 by a predetermined slight space from the drum 1, and rotatably supported by the bearings (not shown) at one end and the other end to the frame 29. The roller 210 is driven to rotate at a predetermined speed in the forward direction of the drum 1 rotation. The roller 211 is a toner supply member for supplying the toner to the roller 210. The roller 211 is disposed in parallel with and in contact with the roller 210, and rotatably supported by the bearings (not shown) at one end and the other end to the frame 29. The roller 211 is driven to rotate at a predetermined speed in the same direction as that of the roller 210 (in the opposite direction at the contacting portion with the roller 210). The frame 29 has a toner container 212 inside. The container 212 contains a predetermined amount of toner (not shown). The container 212 has a toner stirring wing 213 disposed to be driven to rotate about the shaft 213*a*. When the wing 213 rotates, the toner contained in the container 212 is stirred and supplied to the roller 211.

The cartridge P is an assembly, the longitudinal direction of which is the axis line direction (rotation axis direction) of the drum 1 with a driven side at one end (cover member 214 side) and a non-driven side at the other end (cover member 215 side) of the drum 1. The top surface of the drum 1 appears outside at the top of the cartridge. The cleaning frame 27, a first frame member portion, and the developing frame 29, a second frame member portion, are disposed at the opposite sides of the drum 1. An elongated gap portion (slit portion) 216 extends from the bottom of the cartridge to the bottom surface of the drum between the frame 27 and the frame 29. The back side cover member 214 has a concave portion (slit opening) 217 which a process cartridge guide portion 251 can enter as guide means (described later) at the position corresponding to the gap portion 216. The front side cover member 215 also has a concave portion (slit opening) 218 at the position corresponding to the slit portion 216. The concave portion 218 may be omitted to enhance the strength of the frame member of the cartridge P, since the guide portion 251 need not enter there. In the embodiment, the concave portion 218 remains enough for the user to see the guide portion 251, and thus, the strength of the frame member of the cartridge P is enhanced without degrading the operability of the user. Each cartridge P is mounted to the corresponding mounted portion 250 in the main body 200A of the apparatus with the driven side inside. A driven portion 219 is disposed concentrically to the axis line of the drum 1 to the back side cover member 214 of the cartridge P.

The first cartridge PY has a container 212 in which yellow (Y) toner is contained and forms a toner image of yellow color on a surface of the drum 1. The second cartridge PM has a container 212 in which magenta (M) toner is contained and forms a toner image of magenta color on the surface of the drum 1. The third cartridge PC has a container 212 in which cyan (C) toner is contained and forms a toner image of cyan color on the surface of the drum 1. The fourth cartridge PK has a container 212 in which black (K) toner is contained and forms a toner image of black color on the surface of the drum 1.

In the state that each cartridge P is mounted to each corresponding mounted portion 250 in a predetermined manner and positioned to an image forming position H (latent image forming position), a driving portion (not shown) of the main body 200A side of the apparatus is joined to the driven portion 219. The image forming position H of the cartridge P is a position to contribute to forming an image on the belt 221, an intermediate transfer member to be described later.

Above the mounted portion 250, an intermediate transfer belt unit 220 as a transfer member is provided. The unit 220 has a flexible endless belt (intermediate transfer belt) 221 as an intermediate transfer member, and a driver roller 222, a secondary transfer opposite roller 223, a tension roller 224 and four primary transfer rollers 225 for circularly moving the belt 221 by supporting and keeping the belt 221 stretched. The rollers 222 and 223 are provided at right side in the main body 200A of the apparatus. The roller 224 is provided at left side in the main body 200A of the apparatus. The four primary transfer rollers 225 correspond to the first to fourth cartridges PY, PM, PC, PK. Each roller 225 is in contact with the top surface of the of the drum 1 of each cartridge P placed at the image forming position H via the lower portion of the belt loop between the roller 224 and the roller 222. The contacting portion between the drum 1 of each cartridge P and the belt 221 is a primary transfer portion T1. A secondary transfer roller 227 of the secondary transfer unit 226 is in contact with the roller 223 via the belt 221. The contacting portion between the roller 227 and the belt 221 is a secondary transfer portion T2. A belt cleaning device 228 is disposed at the belt winding portion of the roller 224.

Below the mounted portion 250, a laser scanner unit 229 is disposed for the main body 200A of the apparatus with the position fixed. The unit 229 is an exposure device for forming an electrostatic latent image on the surface of the drum by performing scan exposure on the drum 1 of each cartridge P mounted to the mounted portion 250 by radiating laser beam L modulated in correspondence with image information on the drum 1. Although not shown in the figure, the unit 229 is formed of laser beam emission means for emitting correspondingly to a time series electrical digital pixel signal of the given image information, a polygon mirror, a reflector, an F-theta lens and the like. Each of the mounted portions 250 has a guide portion 251 serving as a guide for the cartridge P inserted into and pulled out from the main body 200A of the apparatus. The guide portion 251 is a thin sheet material extending in the front-back direction and protruding upward with the base 252 fixed to and provided for the top surface frame 230 of the unit 229. When each cartridge P is mounted to the mounted portion 250 in a predetermined manner, the guide portion 251 is in the gap portion 216 between the frame 27, the first frame member, and the frame 29, the second frame member. The guide portion 251 has a hollow portion 253 therein, and slit openings 254 and 255 formed along the longitudinal direction on the bottom and the top of the hollow portion 253. The opening 254 corresponds to a laser beam emission opening 231 provided on the top surface frame 230 of the unit 229. The opening 255 faces the bottom surface of the drum 1.

Below the unit 229, a feeding unit 232 is provided. The unit 232 includes a feeding tray 233, a feeding roller 234 and like. Sheets of recording materials S are stacked in the tray 233. The tray 233 is loadable from the front side of the apparatus 200 (front loading). A recess provided for a front plate of the tray 233 is denoted by 233*a*. At the right side in the main body 200A of the apparatus, a recording material conveyance path Z is provided from the roller 234 to the top right portion of the main body 200A of the apparatus. The conveyance path Z is made of a conveyance guiding plate and the like. From the bottom to the top of the conveyance path Z, a pair of recording material separating conveying rollers 235, a registration roller unit 236, a secondary transfer roller 227, a fixing unit (fix device) 237 and a delivery unit 238 with a pair of delivery rollers 239 are provided. The unit 237 includes a fixing film unit and a pressure roller. A delivery tray 240 for receiving a recording material with an image formed is provided for the top of the main body 200A of the apparatus.

The operation for forming a full-color image is shown below. Based on an image forming start signal, a driving force is transmitted from the driving portion at the main body 200A side of the apparatus to the driven portion 219 of the cartridge P side. That drives the drum to rotate in the clockwise direction indicated by an arrow in FIG. 14B at a predetermined speed. The charge roller 22 rotates following the rotation of the drum 1. The toner roller 10 and the supply roller 11 are driven to rotate in the counterclockwise direction indicated by an arrow at a predetermined speed. The wing 213 is also driven to rotate in the clockwise direction indicated by an arrow at a predetermined speed. The belt 221 is driven to rotate in the counterclockwise direction indicated by an arrow (forward direction of the drum rotation) at a speed corresponding to the speed of the drum 1. In synchronization with the driving, a predetermined charging bias is applied to the charge roller 22 at predetermined control timing in each cartridge P and the surface of the drum 1 is uniformly charged to a predetermined polarity and potential. Laser beam L modulated according to the image information is emitted upward from the opening 231 of the top surface frame 230 of the unit 229. The laser beam L enters the hollow portion 253 from the opening 254 at the bottom of the guide portion 251, exits from the opening 254 on the top surface and forms an image on the bottom surface of the drum 1. That is, the hollow portion 253 of the guide portion 251 serves as an exposure optical path from the unit 229 to the drum 1. As a result, the surface of the drum 1 charged by the charge roller 22 is subjected to the main scan exposure by the laser beam L emitted from the unit 229 and an electrostatic latent image according to the image information of the corresponding color is formed on the surface of each drum 1 at predetermined control timing. The formed electrostatic latent image is developed as a toner image by the toner roller 210. A predetermined developing bias is applied to the toner roller 210 at predetermined control timing.

Through the above described electrophotographic image forming process operation, a yellow toner image corresponding to a yellow component of a full-color image is formed on the drum 1 of the first cartridge PY. The toner image is transferred (intermediate transferred) onto the belt 221 by the transfer portion T1. On the drum 1 of the second cartridge PM, a magenta toner image corresponding to a magenta component of the full-color image is formed. The toner image is transferred onto the belt 221 by the transfer portion T1 so that the image is superimposed on the yellow toner image which has already been transferred on the belt 221. On the drum 1 of the third cartridge PC, a cyan toner image corresponding to a cyan component of the full-color image is formed. The toner image is transferred onto the belt 221 by the transfer portion T1 so that the image is superimposed on the yellow and magenta toner images which have already been transferred on the belt 221. On the drum 1 of the fourth cartridge PK, a black toner image corresponding to a black component of the full-color image is formed. The toner image is transferred onto the belt 221 by the transfer portion T1 so that the image is superimposed on the yellow, magenta and cyan toner images which have already been transferred on the belt 221. Consequently, an unfixed full-color (four colors) toner image is formed on the belt 221 by the yellow, magenta, cyan and black toner images. A primary transfer bias of a predetermined potential in reverse polarity of that of the charge polarity of the toner is applied from the power supply (not shown) to each primary transfer roller 225. After the primary transfer of the toner image onto the belt 221, the residual toner remaining on the surface of the drum 1 is removed by a blade 24 and stored in the container 26.

On the other hand, when the roller 216 is driven at predetermined control timing and the top surface of the left side of the recording material S raised by a lifter plate 233*b* comes into contact with the roller 234, the top recording material stacked in the tray 233 is drawn leftward and sent out, separated one by one by the pair of rollers 235. The sent out recording material S is introduced into the secondary transfer portion T2 at predetermined control timing in synchronization with the image formation onto the belt 221 in the unit 236. A secondary transfer bias of a predetermined potential in reverse polarity of that of the charge polarity of the toner is applied from the power supply (not shown) to the roller 227. Through the conveyance process of the recording materials S at the transfer portion T2, the four color superimposed image on the belt 221 is transferred onto the surface of the recording materials S at a time one by one. The recording material S is moved out from the transfer portion T2, separated from the surface of the belt 221, introduced into the unit 237 and heated and pressed by a fixing nip portion. As a result, the toner image is fixed to the recording material S. The recording material S is moved out of the unit 237 and discharged as a full-color image formation product onto the tray 240 by the pair of rollers 239 of the unit 238. After the separation of the recording material from the belt 221, secondary transfer residual toner remaining on the surface of the belt 221 is removed by the device 228.

When a double sided image forming mode is selected, the recording material S having an image formed on one side is sent out from the unit 237, rerouted to the pair of reverse rollers 242 side by the operation of a both-face flapper 241 of the unit 238, and conveyed to be discharged onto the tray 240 by the pair of rollers 242. When the back end of the recording material S reaches the flapper 241, the flapper 241 performs a switchback operation and the pair of rollers 242 is reversely driven. As a result, the recording material S is introduced into a both-face conveyance path 243, relayed by pairs of conveyance rollers 244 and 245 and resupplied to the registration roller pair unit 236 with the surfaces reversed. As in the image formation on one surface, the recording material S is conveyed through the path of the roller pairs 239 of the secondary transfer portion T2, the unit 237 and the unit 238 and discharged as a double sided image formed product onto the tray 240.

A manual sheet feed tray 246 is disposed at the right side of the apparatus 200. When not in use, the tray 246 can be refolded at the right side of the apparatus 200 to be stored. FIG. 13 shows the tray 246 stored away. When in use, the manual feed tray 246 is opened as shown by the two-dot chain line in FIG. 13A.

[Cartridge Exchange]

As each cartridge P is used for image formation, the toner contained in the container 12 is consumed. Then, detecting unit (not shown) for detecting the amount of the toner remaining in each cartridge is provided for each cartridge P. The amount of the remaining toner detected by the detecting unit is compared with a threshold value preset for providing a pre-warning or warning of the lifetime of the cartridge by the control circuit portion 2102 of the main body 200A of the apparatus. When the amount of the residual toner in the cartridge is smaller than the preset threshold value, the pre-warning or warning of the lifetime of the cartridge is displayed on a display portion of a printer control portion 2105 or a display portion of the host device H. As a result, the image forming apparatus prompts the user to prepare a cartridge for exchange or to replace the cartridge with a fresh one to maintain the output image quality.

In the apparatus 200 of the embodiment, the exchange of the cartridge P is performed as below. On the front side of the main body 200A of the apparatus, a door 2101 is provided. When the door 2101 is opened, an opening 2104 at the front side of the main body 200A of the apparatus is opened and the non-driven sides of the cartridges P mounted to the respective mounted portions 250 appear. A linkage (not shown) that links with the opening operation of the door 2101 raises the intermediate transfer belt unit 220 from the mounted portion 250 to the retracted position and the belt 221 of the unit 220 is spaced from the drum 1 of each cartridge P mounted to each mounted portion 250. That allows the user to access the cartridge P that is mounted to the mounted portion 250 in the main body 200A of the apparatus to pull out the cartridge P by front access. Also, that allows the user to push the cartridge P into the corresponding mounted portion 250 in the main body 200A of the apparatus by front access. Mounting and demounting of the cartridge P to and from the mounted portion 250 of the main body 200A of the apparatus is side-oriented, allowing the cartridge P to be mounted and demounted substantially in parallel with the axis line direction of the drum 1 thereof at the front side of the main body of the apparatus. FIG. 13B shows the apparatus with the first cartridge PY pulled out from or inserted into the mounted portion 250Y in the main body of the apparatus 200A. X is the direction in which the cartridge P is inserted into the main body 200A of the apparatus and Y is the direction in which the cartridge P is pulled out from the main body 200A of the apparatus. After replacing the old cartridge P with a fresh one by opening the door 2101 in the above-described manner, the door 2101 is closed. A linkage (not shown) that links with the closing operation of the door 2101 lowers the unit 220 from the retracted position to the position where the belt 221 comes into contact with the top surface of the drum 1 of each cartridge P mounted to each mounted portion 250. As a result, the apparatus 200 recovers the state that it can perform the image forming operation.

The door 2101 is provided on the front side of the main body 200A of the apparatus as the openable and closable member movable between a closing position (shutting position) E for closing the opening 2104 and an opening position F for opening the opening 2104. In the embodiment, the door 2101 can be rotatably opened or closed about a shaft (hinge shaft) 2101*b*, provided at a lower edge side of the door, in the left-right direction at the front side of the main body 200A of the apparatus where the shaft 2101*b* is supported by a bearing member (not shown) at the main body 200A side of the apparatus. The door 2101 can be rotated by the user in the raising direction about the shaft 2101*b* and moved to the closing position E for closing the opening 2104. The closing state of the door 2101 can be held by the holding member (not shown). The door 2101 at the closing position E can be rotated by the user with the fingers at a recess 2101*a* or by releasing the hold, pulling the door 2101 toward the front side of the main body 200A of the apparatus about the shaft 2101*b* to a substantially horizontal place. The closing state of the door 2101 can be held by the holding member (not shown). As a result, the door 2101 can be moved to the opening position F for largely opening the opening 2104. The opening 2104 is an opening for letting the cartridge P pass through to be inserted into or pulled out from the corresponding mounted portion 250 in the main body 200A of the apparatus.

[Guide Portion]

The guide portion (guide means) 251 for guiding the cartridge P inserted into and pulled out from the main body 200A of the apparatus at the mounted portion 250 will be described in detail. The guide portions 251 of the mounted portions 250 have the same configuration. The guide portion 251 is a thin sheet material extending in the front-back direction and protruding upward with the base 252 fixed to and provided for the top surface frame 230 of the unit 229 as described above. When each cartridge P is mounted to the mounted portion 250 in a predetermined manner, the guide portion 251 is in the gap portion 216 between the frame 27, the first frame member, and the frame 29, the second frame member. That is, the guide portion 251 is disposed between the first frame member portion 27 and the second frame member portion 29 of the cartridge P. The guide portion 251 has a portion 258 that can come into contact with the cartridge P as described later.

In the configuration in which the cartridge guides are moved in the longitudinal direction of the drum for mounting and demounting, the cartridge guides are disposed at both sides of the cartridge P when the cartridge P is mounted and demounted at the front side. In this case, when the cartridge guides are provided corresponding to the four cartridges PY, PM, PC and PK, five cartridge guides are required. The regions for the cartridge guides disposed at the left side of the cartridge PY and at the right side of the cartridge PK increases the size of the main body of the apparatus in the cross direction. Spaces for the cartridge guides are also required between the four cartridges PY, PM, PC and PK; therefore, the cartridges PY, PM, PC and PK need to be placed by a wide interval.

When the process guide portion 251 is disposed between the first frame member portion 27 and the second frame member portion 29 of the cartridge p as in this embodiment, guides need not be disposed at the left and right to the cartridges PY and PK which are disposed at both ends. The cartridges PY, PM, PC and PK can be placed by a narrower interval. As a result, the product may be downsized and the number of parts may be reduced.

Figure 16A:
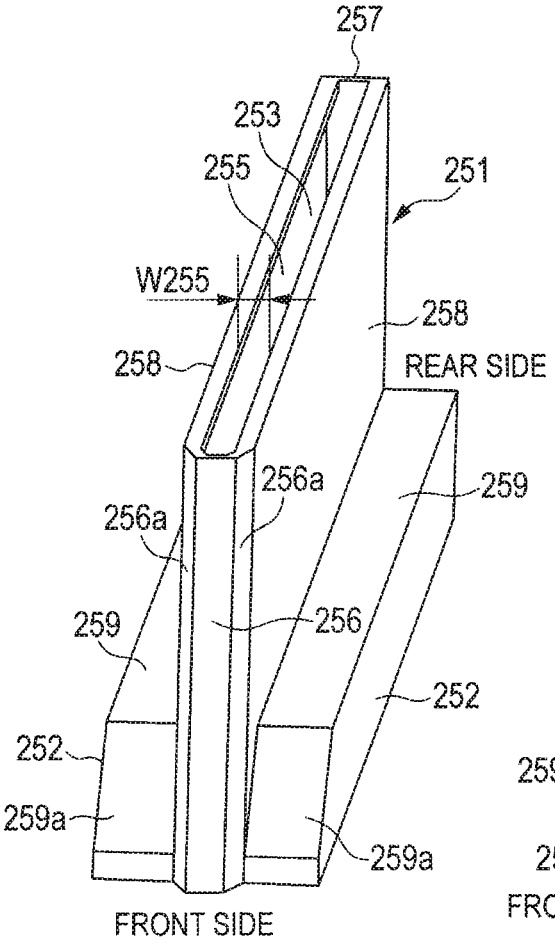
FIG. 16A is a perspective view of a guide portion and FIG. 16B is a perspective view of the guide portion viewed from below.
Figure 16B:
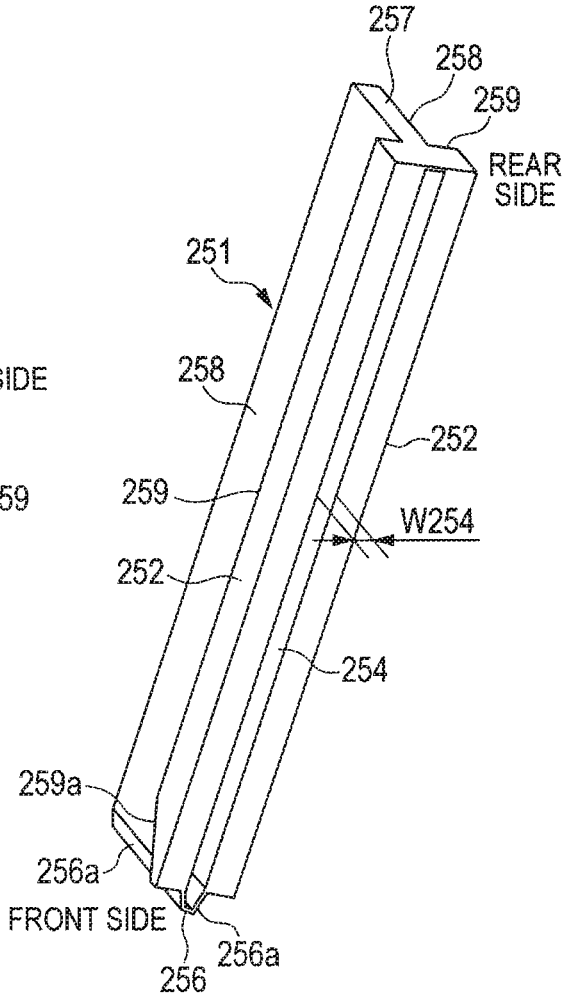

FIG. 16A is a perspective view of the guide portion 251 and FIG. 16B is a perspective view of the guide portion 251 viewed from below. The guide portion 251 according to the embodiment has a hollow portion 253 therein, and slit openings 254 and 255 formed along the longitudinal direction on the bottom and the top of the hollow portion 253 to secure the exposure optical path from the unit 229 to the drum 1 for forming an electrostatic latent image on the drum 1. The widths W254 and W255 of the slit openings 254 and 255 are secured 2 mm to 6 mm so as not to interfere with the optical path. Having the front wall surface 256 and the back wall surface 257 at the front and back portions in the direction to mount the cartridge, the guide portion 251 according to the embodiment can be strong enough for a resin guide portion 251.

The guide portion 251 also has a horizontal regulating wall (portion that can be in contact with the cartridge P) 258 for guiding the cartridge P in the left-right direction and a vertical regulating wall 259 for guiding the cartridge P in the vertical direction. The vertical regulating wall 259 is provided along the longitudinal direction of the guide portion 251 at the left and right sides of the guide portion 251 on the base 252 of the guide portion 251. The guide portion 251 has a height direction receiving shape portion 259*a* and a width direction receiving shape portion 256*a* to facilitate the mounting of the cartridge P. The height direction receiving shape portion 259*a* is formed as a rising slope in the direction to push the cartridge at the front side portion of the vertical regulating wall 259. The width direction receiving shape portion 256*a* is formed as a chamfer portion to chamfer the left and right corners of the front wall surface 256 of the guide portion 251.

The cartridge P is inserted into the mounted portion 250 as below. On the door 2101 opened to a substantially horizontal posture, the cartridge P is placed to face the corresponding mounted portion 250 with the driven side inside. The cartridge P is slid on the door 2101 and pushed from the opening 2104 into the main body 200A of the apparatus. According the movement, the concave portion 217 on the back side cover member 214 of the cartridge P is positioned to the front wall surface 256 of the guide portion 251. Then, the front wall surface 256 enters the concave portion 217. In this case, since the width direction receiving shape portion 256*a* is formed on the front wall surface 256, the front wall surface 256 easily enters the concave portion 217. The left and right portions of the bottom edge of the back side cover member 214 are placed in correspondence with the rising slopes 259*a* as the height direction receiving shape portions on the left and right portions of the guide portion 251 with the concave portion 217 inward. As the cartridge P is further inserted into the apparatus, the cartridge P is guided by the rising slopes 259*a* upward into the main body 200A of the apparatus and the bottom of the first frame member portion 27 and the bottom of the second frame member portion 29 mount on the vertical regulating walls 259 of respective sides. The guide portions 251 enter the gap portion 216 between the bottom of the first frame member portion 27 and the second frame member portion 29. Thereafter, the cartridge P is inserted into the main body 200A of the apparatus along the guide portion 251 while guided by the horizontal regulating wall 258 of the guide portion 251 in the left-right direction and by the vertical regulating wall 259 in the vertical direction. When the cartridge P is sufficiently pushed to a predetermined insert-in mounting position, a stopper portion (not shown) prevents further insert-in movement. The cartridge P is held to the insert-in mounting position by an operation of the toggle mechanism (not shown), for example. The guide portion 251 enters between the bottom of the first frame member portion 27 and the second frame member portion 29. That insert-in mounting position for the cartridge P is the image forming position H for the cartridge P. Since the door 2101 is opened during the insert-in movement of the cartridge P into the main body 210A of the apparatus and the unit 220 is moved and held to the retracted position as described above, the drum 1 and the belt 221 do not rub against each other. The cartridge P is pulled out from the main body 200A of the apparatus in a reverse operation to the insert-in operation.

Figure 17A:
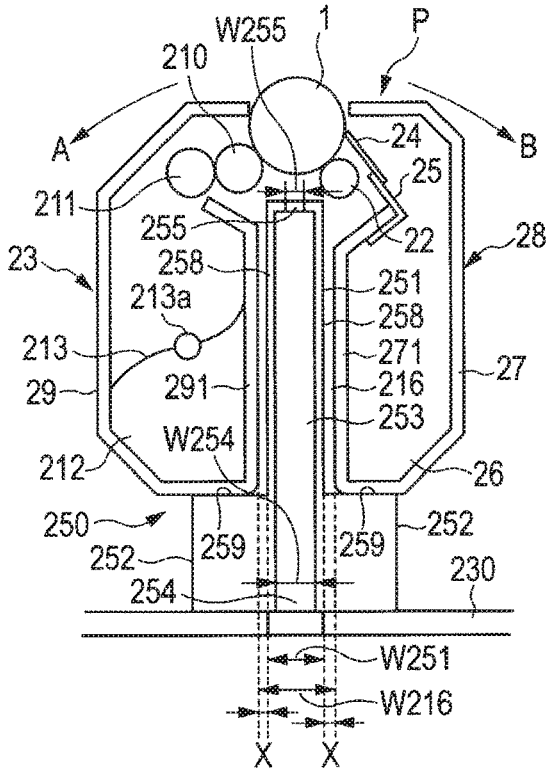
FIGS. 17A and 17B are illustrations of a guiding action of the guide portion.
Figure 17B:
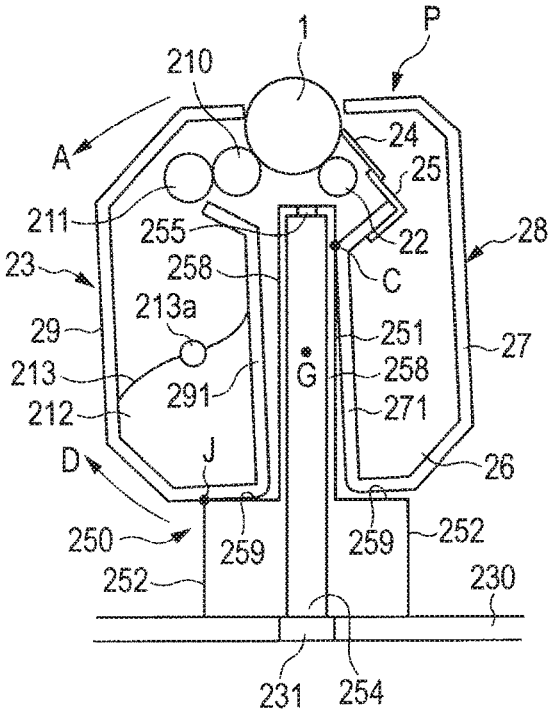

As shown in FIG. 17A, the cartridge P has contacting portions 271 and 291 which come in contact with the guide portion 251. The width W216 of the gap portion 216 of the cartridge P for the guide portion 251 to enter is designed wider than the width W251 of the guide portion 251 to make a gap x from the guide portion 251 for easier insertion of the guide portion 251. Due to the gap x, however, the cartridge P rotates to the arrow A or the arrow B, if slightly, during the insert-in mounting operation. If the gap x is wide, it is convenient for the user to push the cartridge P into the main body 200A of the apparatus, but the cartridge P rotates by a large angle which reversely degrades the usability. Then, the gap x is set to about 0.5 mm which does not degrade the usability even during the mounting operation of the cartridge P. FIG. 17B shows the cartridge P rotating to the arrow A. The horizontal regulating wall (the portion that can be in contact with the cartridge P) 258 also prevents the rotation of the cartridge P.

The horizontal regulating wall 258 for regulating the width direction of the cartridge P is set high to prevent the rotation of the cartridge P due to the gap x. That is, the embodiment is adapted to have the guide portion 251 guide at least at the height of the gravity position G of the cartridge P. For the purpose of improving the usability in particular, the guide portion 251 is made to guide at the height higher than the gravity position G of the cartridge P. Specifically, the guide portion 251 has a portion where it can be in contact with the process cartridge at a point lower than the gravity position G of the process cartridge P and a portion where it can be in contact with the process cartridge at a point higher than the gravity position G of the process cartridge P in the vertical direction. As shown in FIG. 17B, if the guide portion 251 can guide at the position higher than the gravity position G of the cartridge P, the cartridge P and the horizontal regulating wall 258 contact with each other at the contact point C. Among the forces applied in the arrow A direction, the horizontal direction force obtains the rotation moment for the clockwise rotation about the contact point C and the force in the arrow D direction. The arrow D direction is opposite to the arrow A direction and the cartridge P is returned to the horizontal posture about the point J. That improves the usability.

The conventional image forming apparatus described in Japanese Patent Application Laid-Open No. 2008-216331 has the guiding member divided and downsized to be set at two or more places for downsizing the main body of the apparatus, but the guiding members guide the positions at a distant from the cartridge gravity. That cannot support the inserted into or pulled out cartridge in a sufficiently stable manner, and thus, the usability needs to be improved. If the guide portion 251 is disposed between the first frame member portion 7 and the second frame member portion 29 and guides at the position higher than the gravity position G as in the present invention, the usability can be improved.

The conventional image forming apparatus described in Japanese Patent Application Laid-Open No. 2008-216331 has the guiding member divided and downsized. Then, the guiding members, even if they are small in size, need to be strong enough to bear the user's operation of the process cartridge and need to be made of strong material such as metal. That increases the cost. Metal as a material for the guiding members may cause electrically harmful effects such as electrical leakage and degradation of electromagnetic interference. That requires preventive components to be set, which increases the cost and consumes the space.

In the embodiment, by disposing the guide portion 251 between the first frame member portion 27 and the second frame member portion 29, the shape of the guide portion 251 can be increased to some extent. As a result, if the guide portion 251 is made of a relatively weak material such as synthetic resin, the guide portion 251 can be suitable for the purpose. That is, if the guide portion 251 is made of resin instead of metal, the guide portion 251 is strong enough for the purpose. Accordingly, the cost can be reduced. In addition, that can prevent the electrical harmful effects such as electrical leakage and degradation of electromagnetic interference which might be caused by metal guiding members 251, and therefore, any preventive components for the problem need not be provided. Consequently, the embodiment can provide the downsized apparatus at a low cost.

Embodiment 6

Embodiment 6 is the apparatus 200 according to Embodiment 5 with the laser scanner unit 229 replaced by a light emitting device unit 229A as an exposure device for exposing the drum 1 of each cartridge P. Since the other configuration of the apparatus 200 is the same as that of Embodiment 5, which is omitted from the description below.

The light emitting device unit 229A includes a light emitting device having arrayed light emitting elements and a lens for condensing light emitted from the light emitting elements for exposing the drum 1. The light emitting device has light emitting elements arrayed in the longitudinal direction of the drum 1 for emitting in accordance with image information to expose the drum 1 in accordance with the image information. As the light emitting element of the light emitting device 26, electroluminescence elements such as liquid crystal devices, semiconductor light-emitting diodes (LED), organic electroluminescence devices (organic EL devices) are used. The semiconductor light-emitting diode is a semiconductor device that emits when a voltage is applied. The organic EL device is self-luminous and an electronic material made of organic compounds that emits when a voltage is applied. As an example of the organic EL devices, an organic molecular luminescent layer is sandwiched by two electrodes and a voltage is applied therebetween. Then, the electrons injected by the electrodes recombine with positive holes to excite the organic molecules, and when the excited organic molecules return to the ground state, the organic EL devices emit. In Embodiment 6, an LED array unit (LED exposure means) is used as the light emitting device unit 29A.

Figure 18A:
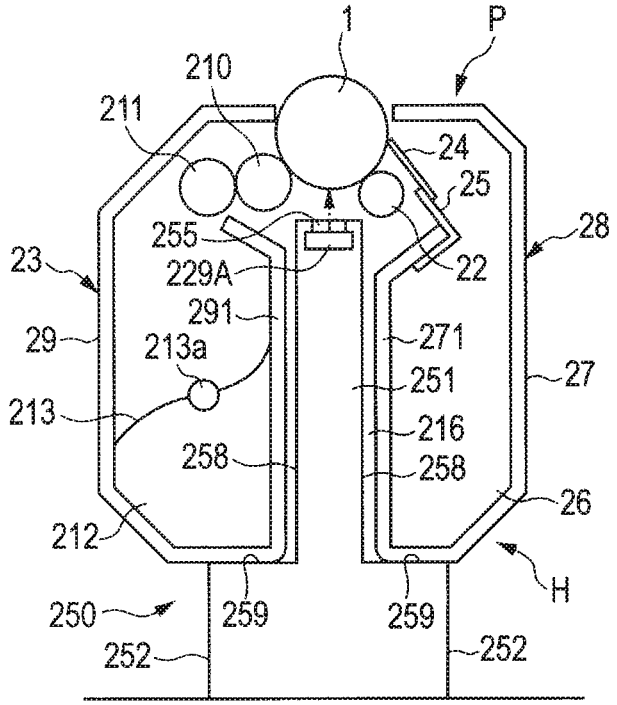
FIGS. 18A and 18B are illustrations of the principal part of the electrophotographic image forming apparatus.
Figure 18B:
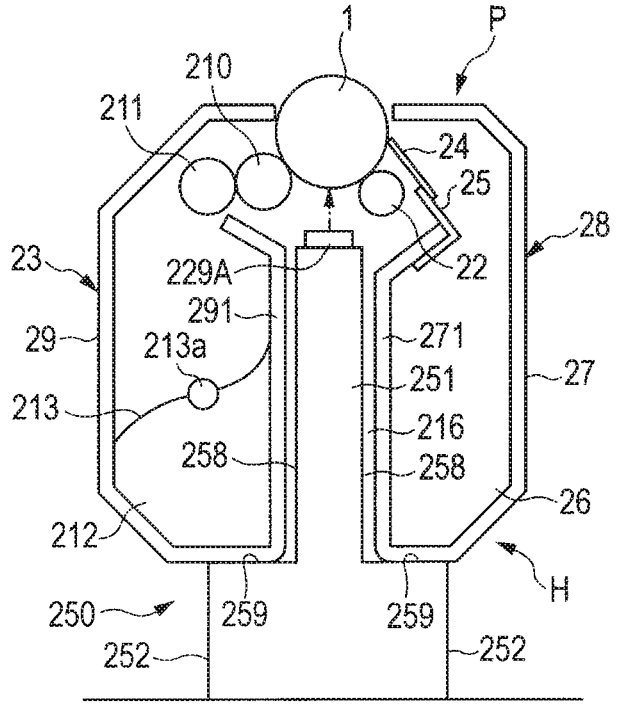

FIG. 18A shows the unit 229A disposed on the inside of the upper part of the guide portion 251. That is, the unit 229A is disposed at the position included in the guide portion 251. In the state that the cartridge P is mounted to the mounted portion 250 of the main body 200A of the apparatus in a predetermined manner, the unit 229A exposes the drum 1 by facing the drum 1 from the position that is a predetermined distance of the optical path away from the bottom of the drum 1 through the slit opening 255 provided in the longitudinal direction of the cartridge P at the top of the guide portion 251. FIG. 18B shows the unit 229A disposed on the outside of the upper part of the guide portion 251 (between the drum 1 and the guide portion 251). In the state that the cartridge P is mounted to the mounted portion 250 of the main body 200A of the apparatus, the unit 229A exposes the drum 1 by facing the drum 1 from the position that is a predetermined distance of the optical path away from the bottom of the drum 1. Even the configuration of the apparatus according to the embodiment can provide the same effects as those of Embodiment 5.

Embodiment 7

Figure 19A:
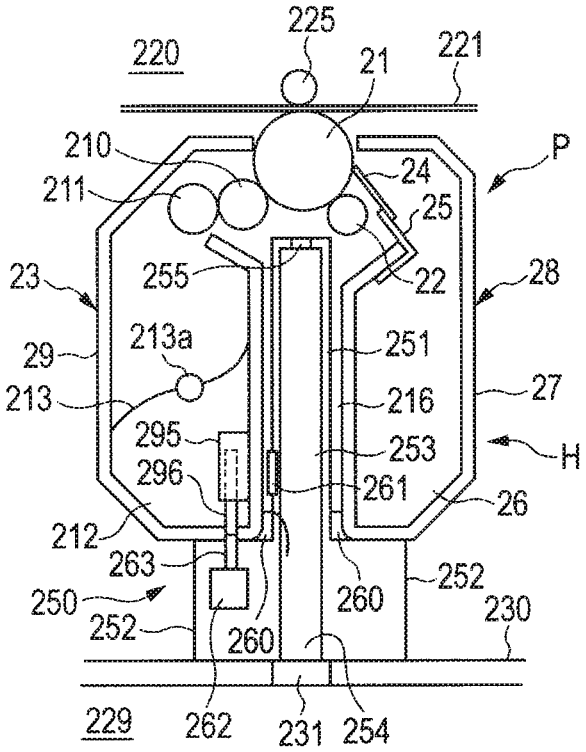
FIGS. 19A and 19B are illustrations of the principal part of the electrophotographic image forming apparatus.
Figure 19B:
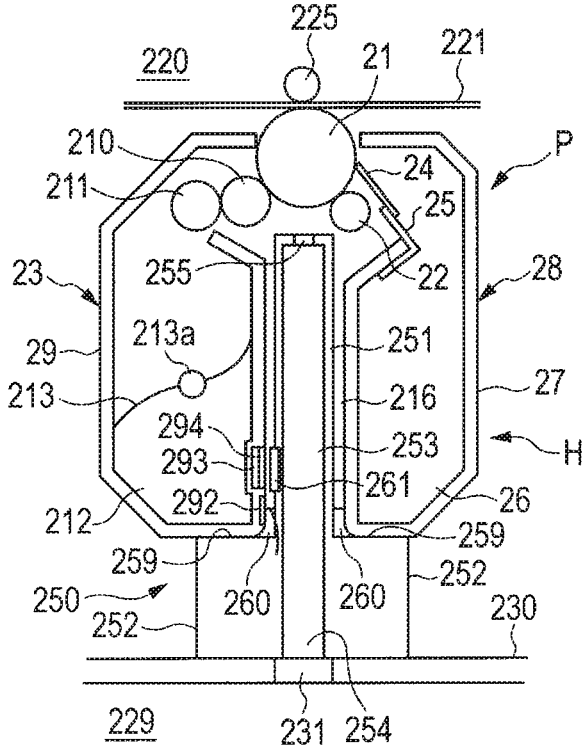

The apparatus 200 according to the embodiment is basically the same as the apparatus 200 of Embodiment 5. The apparatus according to the embodiment includes a cartridge side detecting unit 295 for detecting the amount of toner contained in the container 212 in the developing unit 23 of the cartridge P as shown in FIG. 19A. The apparatus 200 also includes a main body side detecting unit 262 which is combined with the unit 295 in the guide portion 251. In the state that the cartridge P is mounted to the main body 200A of the apparatus, the unit 295 and the unit 262 can detect the amount of the toner.

Figure 20A:
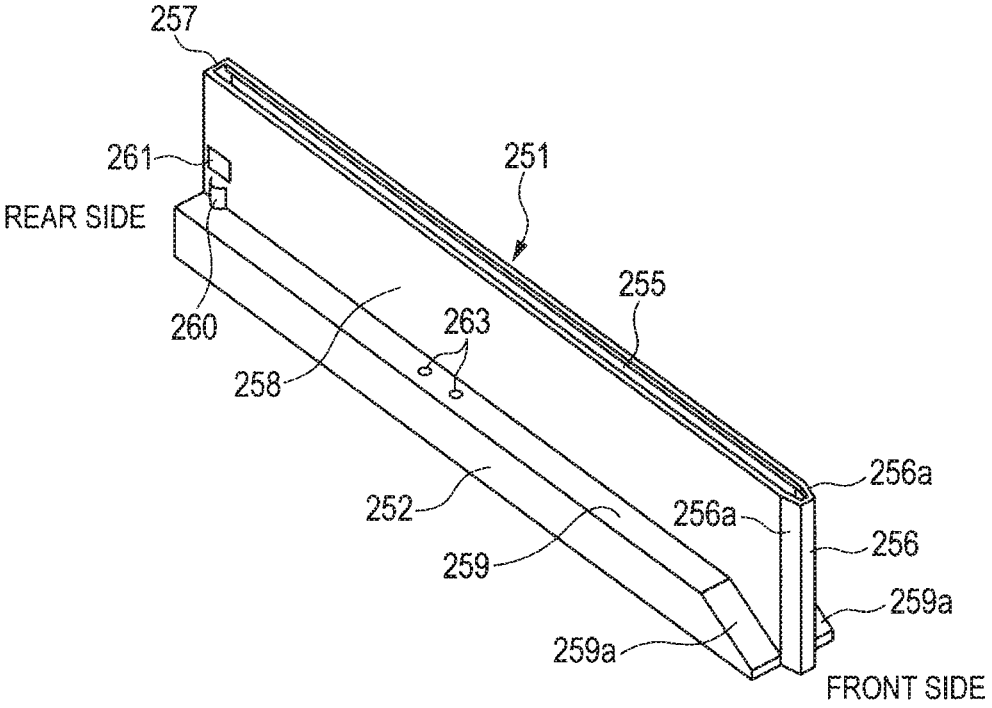
FIGS. 20A and 20B are perspective views of the guide portion.
Figure 20B:
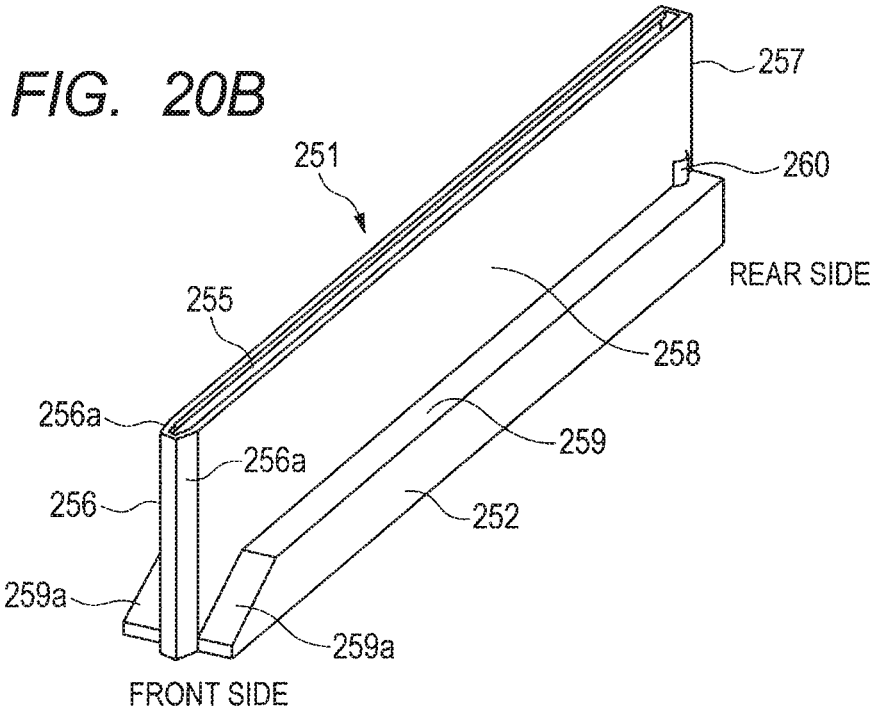

In the embodiment, the unit 295 and the unit 262 are optical detection units, and the unit 295 has two light guides 296 for the incident side and the outgoing side respectively. The unit 262 has a light source and a light receiving element. The bottom end portions of the two light guides 296 of the unit 295 appear at the bottom of the developing unit 23. The unit 262 is provided on the inside of the vertical regulating wall 259 at the left of the guiding member 251, and as shown in FIG. 20A, the wall 259 has two holes 263 for the outgoing side (light source side) and the incident side (light receiving side) on the surface. In the state that the cartridge P is mounted to the mounted portion 250 in a predetermined manner, the unit 295 and the unit 262 are combined by the bottom end portions of the two light guides 296 at the developing unit side in correspondence with the two holes 263 at the guiding member 251 side. Then, light from the light source at the unit 262 side passes through the light guides 296 at the unit 295 side to be returned to the light receiving element at the unit 262 side and received. In this case, while the wing 213 is rotating, proportion of the turn-on time and the turn-off time of the light receiving element based on intermittent light returning from the unit 295 side to the light receiving element of the unit 262 changes according to the amount of toner contained in the container 212. The control circuit portion 2102 detects the amount of toner in the container 212 by calculation based on a proportion signal regarding the turn-on time and the turn-off time output from the light receiving element. Since the optical toner amount detecting unit by the unit 295 and the unit 262 is publicly known, it is omitted from the detailed description.

The cartridge P is provided with an electronic information recording element (memory member, cartridge memory, semiconductor memory: storage means such as Random Access Memory RAM) 293 for recording information including the usage of the cartridge. In the embodiment, the recording element 293 is provided on the contacting portion 291 that comes into contact with the guide portion 251 of the second frame member portion 29. An information giving-receiving unit 261 for writing and reading information to and from the recording element 293 is disposed on the horizontal regulating wall 258 that is to the left of the guide portion 251. In the state that the cartridge P is mounted to the mounted portion 250 in a predetermined manner, the recording element 293 is associated with the unit 261 to be able to communicate with each other. The control circuit portion 2102 writes and reads information to and from the recording element 293 by the communication between the information transmission portion 294 of the recording element 293 and the unit 261. The communication between the recording element 293 and the unit 261 may be either a contact type or a non-contact type.

The cartridge P is provided with a cartridge side electrical contact 292. In the embodiment, the contact 292 is disposed at the back end portion side of the contacting portion 291 that comes into contact with the guide portion 251 of the second frame member portion 29. The main body side electrical contact 260 corresponding to the contact 292 is disposed at the back end portion side of the horizontal regulating wall 258 that is to the left of the guide portion 251. The contact 260 is made of a conducting elastic material. In the state that the cartridge P is mounted to the mounted portion 250 in a predetermined manner, the contact 260 resiliently comes into contact with the contact 292 and becomes electrically conductive. As a result, the bias is applied from the main body 200A side of the apparatus to the cartridge P side via the contacts 260 and 292.

It is preferable to dispose an even number of contacts 260 at the positions facing each other. That can offset the force applied to the cartridge P at the contacts 260. Further, disposing of the contacts 260 at the guiding member 251 prevents the force from being applied in the direction Y in which the cartridge P is pulled out from the main body 200A of the apparatus. As a result, a driving portion on the main body 200A side of the apparatus for transmitting the drive to the cartridge P and a driven portion 219 at the cartridge P side seldom change their positions, which stabilizes transmission of the drive, and therefore, provides a good image. If the cartridge P slightly moves to the front side of the main body 200A of the apparatus, the contact pressure of the contacts 260 does not decrease and the electric connection can be stably secured.

The configuration of the apparatus according to Embodiment 7 also provides the same effects as those of Embodiment 5. In the conventional image forming apparatus, residual toner detecting unit, the electronic information recording element and the electrical contact of the cartridge need to be disposed on the outside surface of the cartridge as mounted to the main body of the apparatus, which hampers downsizing of the image forming apparatus. With the above-described configuration, the apparatus 200 according to Embodiment 7 is capable of including the residual toner detecting unit, the electronic information recording element and the electrical contact on the inside surface of the cartridge as mounted on the main body of the apparatus. That allows the outside surface of the cartridge to be used for the other purposes, which allows downsizing of the image forming apparatus. The image forming apparatus having the cartridges PY, PM, PC and PK disposed in a row can have the cartridges disposed more closely. That allows downsizing of the product. The positions of the contacts 260, the unit 261 and the unit 262 are not limited to the arrangement for the guiding members 251 of the embodiment. The residual toner detecting unit 262 and 295 are not limited to the optical sensor of the embodiment. Although the apparatus 200 according to Embodiments 5 to 7 are the in-line type color printer, the apparatus may be an electrophotographic image forming apparatus such as a mono-color printer or a copying machine.

Embodiment 8

Figure 21A:
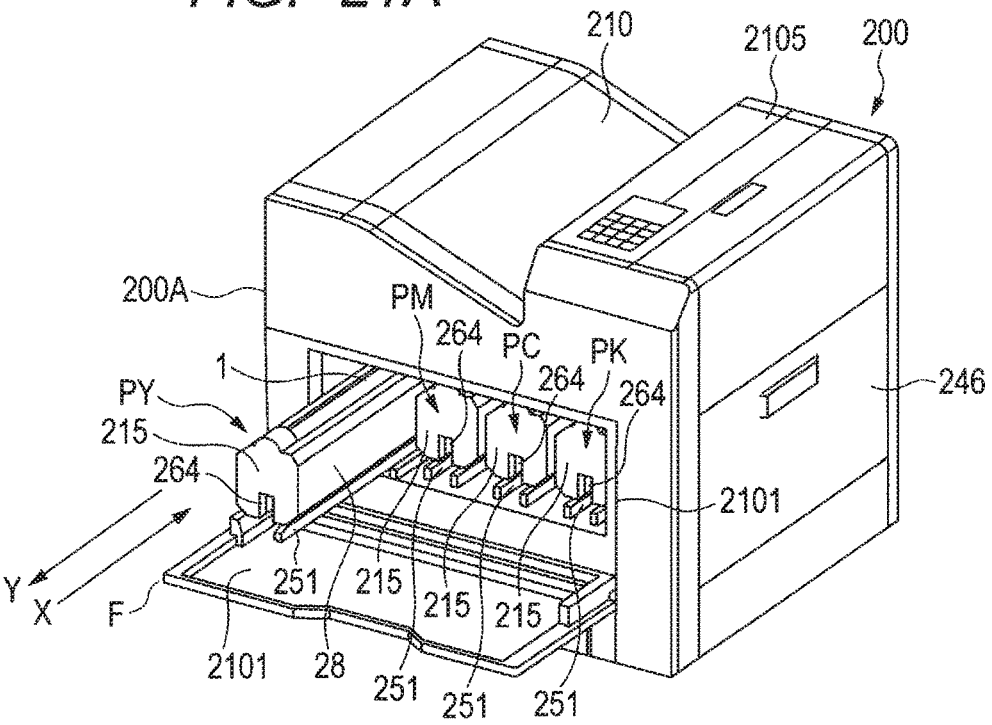
FIG. 21A is an outside perspective view of the apparatus with the front door opened for one of process cartridges pulled out from or inserted into the mounted portion in the main body of the apparatus and FIG. 21B is a partial enlarged longitudinal sectional front view of the same apparatus.
Figure 21B:
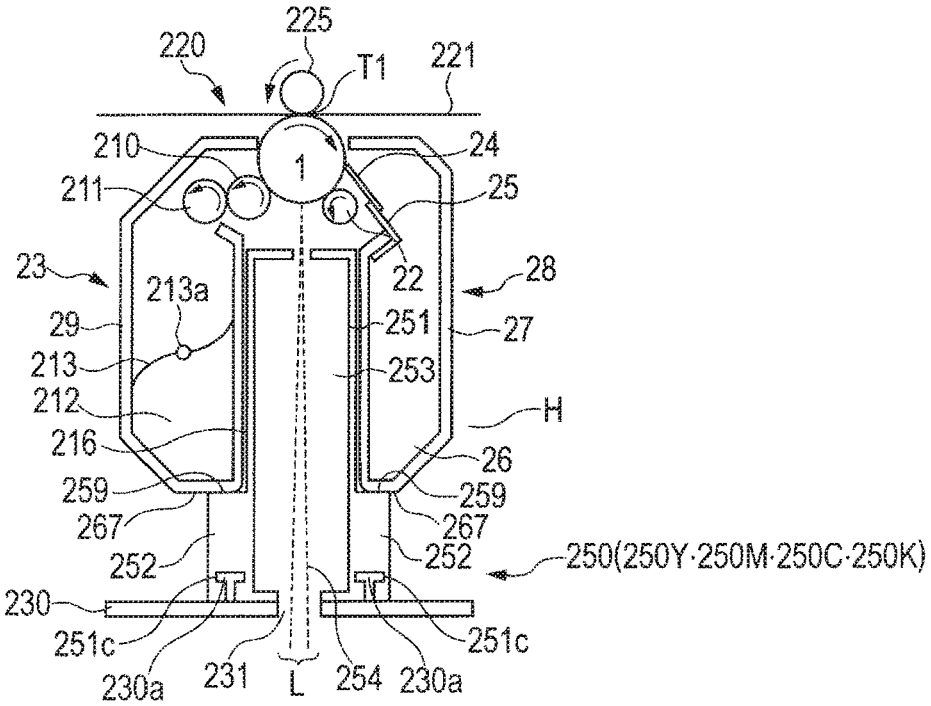
Figure 22B:
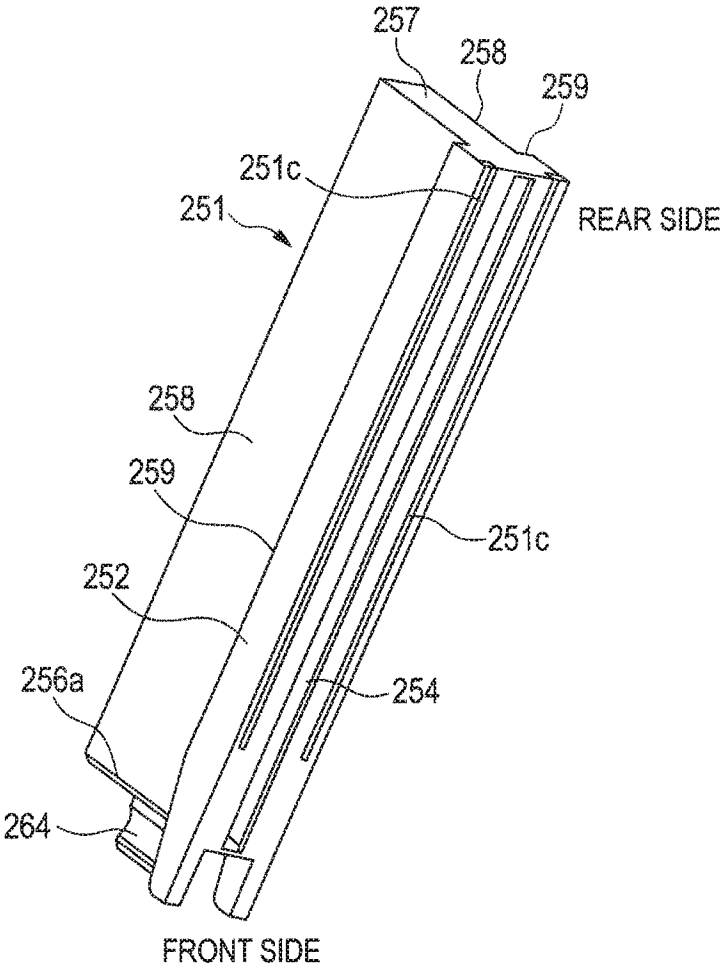
FIG. 22A is a perspective view of the guide portion and FIG. 22B is a perspective view of the guide portion viewed from below.
Figure 22A:
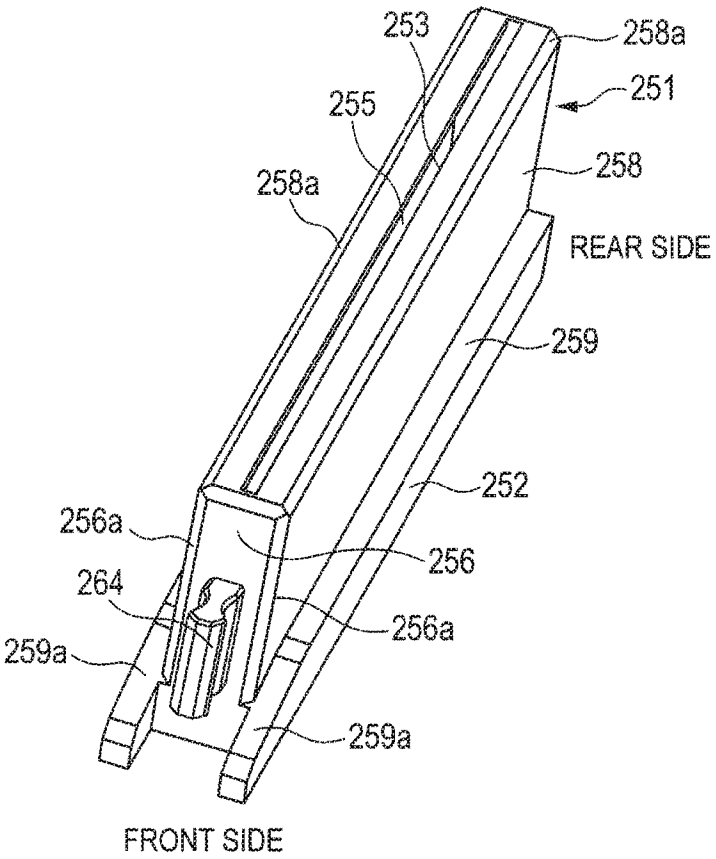

The apparatus 200 according to Embodiment 8 is basically the same as the apparatus 200 according to Embodiment 5. The apparatus of this embodiment has a mechanism of moving out the guide portion (guide means) 251 as shown in FIG. 21A. As shown in FIG. 21B, the guide portion 251 has a rail groove 251*c* and a rail 230*a* corresponding to the rail groove 251*c* on the top surface frame 230, and the guide portion 251 is disposed movably in the front-back direction along the rail 230*a*. FIG. 22A is a perspective view of the guide portion 251 viewed from above and FIG. 22B is a perspective view of the guide portion 251 viewed from below. As shown in FIGS. 22A and B, the guide portion 251 has a knob 264 in the front for the user to access the guide portion 251 to pull it out to the front side of the apparatus.

[Cartridge Insert Procedure]

Figure 23:
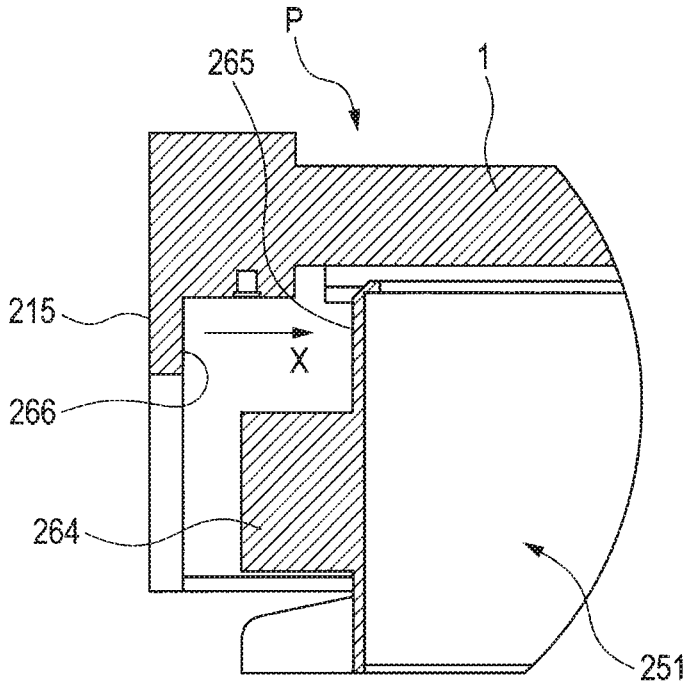
FIG. 23 is a partial enlarged longitudinal sectional side view of the apparatus with the guide portion and one of the process cartridges pulled out from or inserted into the mounted portion in the main body of the apparatus.

The cartridge P is inserted into the mounted portion 250 as below. When the guide portion 251 corresponding to the cartridge P to be inserted into is pulled out to the front side and the cartridge P is placed on the guide portion 251 to fit the gap portion 216 of the cartridge P into the guide portion 251, the cartridge P looks like the cartridge PY shown in FIG. 21A. The vertical regulating wall 259 comes into contact with the bottom 267 of the cartridge P. To facilitate the insertion of the cartridge P on that occasion, chamfers 258*a* are formed at the upper part of the guide portion 251 on the left and right sides in the longitudinal direction. When the front side cover member 215 is pushed toward the back side in the direction of arrow X as shown in FIG. 23, a contact surface 265 and a contact surface 266 come in contact with each other and the bottom 267 and the vertical regulating wall 265 rub against each other; that push the guide portion 251 into the main body 200A of the apparatus. The cartridge P is inserted into the main body 200A of the apparatus along the guide portion 251 while guided by the horizontal regulating wall 258 of the guide portion 251 in the left-right direction and by the vertical regulating wall 259 in the vertical direction. When the cartridge P is sufficiently pushed to a predetermined insert-in mounting position, a stopper portion (not shown) prevents further insert-in movement for the guide portion 251. The cartridge P is held to the insert-in mounting position by an operation of the toggle mechanism (not shown), for example. That insert-in mounting position for the cartridge P is the image forming position H for the cartridge P. Since the door 2101 is opened during the insert-in movement of the cartridge P into the main body 200A of the apparatus and the unit 220 is moved and held to the retracted position as described above, the drum 1 and the belt 221 do not rub against each other.

The advantages of disposing the guide portion 251 movably in the front-back direction as in Embodiment 8 are as below. When the cartridge P is inserted into the main body 200A of the apparatus, the user only needs to place the cartridge P on the guide portion 251, having the guide portion 251 support the dead weight of the cartridge P, and press either the cartridge P or the guide portion 251 in the axial direction of the drum 1. That reduces the user's load of supporting the dead weight of the cartridge P, allowing the user to easily push the cartridge P in the main body 200A of the apparatus. Therefore, that can further improve the usability.

[Cartridge Pull-Out Procedure]

The cartridge P is pulled out from the mounted portion 250 as below. As described above, when the door 2101 is moved to the opening position F to open the opening 104, the non-driven side of the cartridge P and the knob 264 appear. The user holds the knob 264 of the guide 251 that holds the cartridge P to be pulled out and pulls out to the front. As a result, the contact surface (guide 251 side) 265 and the contact surface 266 (cartridge P side) in the front-back direction of the guide portion 251 and the cartridge P come in contact with each other and the guide portion 251 and the cartridge P are pulled out to the front. Since the guide portion 251 supports the dead weight of the cartridge P until the cartridge P is pulled out to the front in that manner, the user's load can be reduced.

By making the gravity position of the cartridge P placed before the front side of the main body 200A of the apparatus when the guide portion 251 is pulled out from the main body 200A of the apparatus, the user can take the gravity position of the cartridge P. That reduces the possibility of receiving the moment due to the dead weight of the cartridge P that might occur in the case when the user takes the position of the cartridge P other than the gravity position. That can further reduce the usability.

As such, the apparatus configuration according to Embodiment 8 provides the same effects as that by Embodiment 5. Moreover, with the configuration of enabling the guide portion to be pulled out, this embodiment can reduce the user's load of pushing or pulling the cartridge P in or out the main body of the apparatus to improve the usability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional of U.S. application Ser. No. 15/827,303, filed Nov. 30, 2017, which is Continuation of U.S. application Ser. No. 15/074,434, filed Mar. 18, 2016, which issued as U.S. Pat. No. 9,869,964 on Jan. 16, 2018, which is a Divisional of U.S. application Ser. No. 14/191,848, filed Feb. 27, 2014, which issued as U.S. Pat. No. 9,348,301 on May 24, 2016, which is a Continuation of U.S. application Ser. No. 13/151,753, filed Jun. 2, 2011, which issued as U.S. Pat. No. 8,755,718 on Jun. 17, 2014, and claims the benefit of Japanese Patent Application No. 2010-128898, filed Jun. 4, 2010, and No. 2010-128897, filed Jun. 4, 2010 which are hereby incorporated by reference herein in their entirety.

What is claimed is:

1. An image forming apparatus configured to form an image on a recording medium, the image forming apparatus comprising:

a main body;

a cartridge provided with a photosensitive member and being removable from the main body;

a light emitting member provided with a plurality of light emitting elements arranged in a rotation axis direction of the photosensitive member and configured to cause the plurality of light emitting elements to emit light to expose the photosensitive member;

a transfer member configured to transfer a toner image formed on the photosensitive member;

a cartridge moving member configured to move the cartridge between a first position for forming the image on the recording medium and a second position in which the cartridge is further retracted away from the transfer member than in the first position; and a light emitting member moving member configured to move the light emitting member between a third position in which the light emitting member exposes the photosensitive member in order to form the image on the recording medium and a fourth position in which the light emitting member is further retracted away from the cartridge than in the third position, wherein the cartridge moving member comprises a supporting member configured to support the cartridge, a first connecting member and a second connecting member, wherein the supporting member comprises the light emitting member moving member, wherein the first connecting member and the second connecting member are respectively connected to the supporting member at positions separated in the rotation axis direction of the photosensitive member, and the first connecting member and the second connecting member are connected to the supporting member and the main body so as to be rotatable with respect to the supporting member and the main body, and wherein the cartridge is movable between the first position and the second position by movement of the supporting member by a rotation of the first connecting member and the second connecting member, and the light emitting member is movable between the third position and the fourth position by the movement of the supporting member by the rotation of the first connecting member and the second connecting member.

2. The image forming apparatus according to claim 1, wherein when the cartridge is located in the second position and the light emitting member is located in the fourth position, the plurality of light emitting elements of the light emitting member are opposed to the photosensitive member and the cartridge can be removed from inside of the main body by moving the cartridge in the rotation axis direction of the photosensitive member.

3. The image forming apparatus according to claim 1, wherein the first connecting member and the second connecting member have a same shape, and the first connecting member and the second connecting member are connected to the cartridge moving member at a same rotation phase.

4. The image forming apparatus according to claim 1, wherein a movement amount by which the light emitting member is moved from the third position to the fourth position is greater than a movement amount by which the cartridge is moved from the first position to the second position.

5. The image forming apparatus according to claim 1, wherein the light emitting member moving member comprises a guide portion configured to guide a movement of the cartridge in order to remove the cartridge located in the second position from the main body, and wherein the guide portion guides the cartridge in a state in which the light emitting member is located in the fourth position.

6. The image forming apparatus according to claim 1, further comprising an operating member configured to move the cartridge moving member and the light emitting member moving member, wherein when the operating member is located in a first predetermined position, the cartridge is located in the first position and the light emitting member is located in the third position, and when the operating member is moved from the first predetermined position to a second predetermined position, the cartridge moving member is moved to move the cartridge to the second position and the light emitting member moving member is moved to move the light emitting member to the fourth position.

7. The image forming apparatus according to claim 6, wherein the main body is provided with an opening through which the cartridge passes when the cartridge is removed from inside of the main body, and wherein the operating member comprises an openable and closable member configured to cover the opening when the operating member is located in the first predetermined position and configured to open the opening so that the cartridge can be removed from the inside of the main body when the operating member is located in the second predetermined position.

8. The image forming apparatus according to claim 1, wherein the light emitting member is moved from the third position to the fourth position within the main body.

9. The image forming apparatus according to claim 1, wherein the cartridge is moved from the first position to the second position within the main body.

10. The image forming apparatus according to claim 1, wherein the cartridge comprises a charging member configured to charge the photosensitive member.

11. The image forming apparatus according to claim 1, wherein the cartridge comprises a member configured to remove developer from the photosensitive member.

12. The image forming apparatus according to claim 1, wherein the cartridge is upwardly moved from the first position to the second position and the light emitting member is upwardly moved from the third position to the fourth position.

13. The image forming apparatus according to claim 1, wherein the plurality of light emitting elements comprises a plurality of light emitting diodes.

14. An image forming apparatus configured to form an image on a recording medium, the image forming apparatus comprising:

a main body;

a plurality of cartridges, each provided with a photosensitive member and being removable from the main body;

a plurality of light emitting members, each corresponding to the photosensitive member of a corresponding cartridge of the plurality of cartridges, each of the plurality of light emitting members being provided with a plurality of light emitting elements arranged in a rotation axis direction of a corresponding photosensitive member, each of the plurality of light emitting members being configured to cause the plurality of light emitting elements to emit light to expose the corresponding photosensitive member;

a transfer member configured to transfer a toner image formed on the photosensitive member of each of the plurality of cartridges;

a cartridge moving member configured to support each of the plurality of cartridges and move each of the plurality of cartridges between a first position for forming the image on the recording medium and a second position in which each of the plurality of cartridges is farther retracted away from the transfer member than in the first position; and a light emitting member moving member configured to move each of the plurality of light emitting members between a third position in which each of the plurality of light emitting members exposes the corresponding photosensitive member in order to form the image on the recording medium and a fourth position in which each of the plurality of light emitting members is farther retracted away from the corresponding cartridge than in the third position, wherein the cartridge moving member comprises a supporting member configured to support the plurality of cartridges, a first connecting member and a second connecting member, wherein the supporting member comprises the light emitting member moving member, wherein the first connecting member and the second connecting member are respectively connected to the supporting member at positions separated in the rotation axis direction of the photosensitive member, and the first connecting member and the second connecting member are connected to the supporting member and the main body so as to be rotatable with respect to the supporting member and the main body, and wherein each of the plurality of cartridges is movable between the first position and the second position by a movement of the supporting member by a rotation of the first connecting member and the second connecting member, and each of the plurality of light emitting members is movable between the third position and the fourth position by the movement of the supporting member by the rotation of the first connecting member and the second connecting member.

15. The image forming apparatus according to claim 14, wherein when the plurality of cartridges are located in the second position and the plurality of light emitting members are located in the fourth position, the plurality of light emitting elements of each of the plurality of light emitting members are opposed to the corresponding photosensitive member and each of the plurality of cartridges can be removed from inside of the main body by moving each of the plurality of cartridges in the rotation axis direction of the corresponding photosensitive member.

16. The image forming apparatus according to claim 14, further comprising an operating member configured to move the cartridge moving member and the light emitting member moving member, wherein when the operating member is located in a first predetermined position, the plurality of cartridges are located in the first position and the plurality of light emitting members are located in the third position, and when the operating member is moved from the first predetermined position to a second predetermined position, the cartridge moving member is moved to move the plurality of cartridges to the second position and the light emitting member moving member is moved to move the plurality of light emitting members to the fourth position.

17. The image forming apparatus according to claim 16, wherein the main body is provided with an opening through which the plurality of cartridges pass when the plurality of cartridges are removed from inside of the main body, and wherein the operating member comprises an openable and closable member configured to cover the opening when the operating member is located in the first predetermined position and configured to open the opening so that the plurality of cartridges can be removed from the inside of the main body when the operating member is located in the second predetermined position.

18. The image forming apparatus according to claim 14, wherein the transfer member comprises a belt onto which the toner image is transferred from the photosensitive member of each of the plurality of cartridges.

19. The image forming apparatus according to claim 18, wherein when the plurality of cartridges are located in the first position, the transfer member is disposed below the photosensitive member of each of the plurality of cartridges.

20. The image forming apparatus according to claim 14, wherein the plurality of light emitting elements comprises a plurality of light emitting diodes.

* * * * *